US011141747B2

(12) United States Patent
Schmon et al.

(10) Patent No.: US 11,141,747 B2
(45) Date of Patent: Oct. 12, 2021

(54) NOZZLE ARRANGEMENT FOR A SPRAY GUN

(71) Applicant: SATA GmbH & Co. KG, Kornwestheim (DE)

(72) Inventors: Ewald Schmon, Grafenberg (DE); Daniel Maier, Boeblingen (DE)

(73) Assignee: SATA GMBH & CO. KG, Kornwestheim (DE)

( * ) Notice: Subject to any disclaimer, the term of this patent is extended or adjusted under 35 U.S.C. 154(b) by 170 days.

(21) Appl. No.: 15/575,549

(22) PCT Filed: May 18, 2016

(86) PCT No.: PCT/EP2016/061057
§ 371 (c)(1),
(2) Date: Nov. 20, 2017

(87) PCT Pub. No.: WO2016/188804
PCT Pub. Date: Dec. 1, 2016

(65) Prior Publication Data

US 2018/0133727 A1 May 17, 2018

(30) Foreign Application Priority Data

May 22, 2015 (DE) ..... 10 2015 006 484.3

(51) Int. Cl.
*B05B 7/06* (2006.01)
*B05B 7/08* (2006.01)

(52) U.S. Cl.
CPC ..... *B05B 7/068* (2013.01); *B05B 7/066* (2013.01); *B05B 7/0815* (2013.01)

(58) Field of Classification Search
CPC ..... B05B 7/068; B05B 7/066; B05B 7/0815
(Continued)

(56) References Cited

U.S. PATENT DOCUMENTS 40,433 A 10/1863 Sees
327,260 A 9/1885 Hart
(Continued)

FOREIGN PATENT DOCUMENTS

AT 153883 6/1997
AT 163577 3/1998
(Continued)

OTHER PUBLICATIONS

Response filed Oct. 6, 2015 to Notice of Non-Compliant Amendment for U.S. Appl. No. 13/698,417.
(Continued)

*Primary Examiner* — Jason J Boeckmann
(74) *Attorney, Agent, or Firm* — Paul D. Bianco; Stephen Bongini; Fleit Intellectual Property Law

(57) ABSTRACT

A nozzle arrangement for a spray gun, in particular a paint spray gun, has at least one paint nozzle and an air cap. The paint nozzle has at least one outlet opening for the material to be sprayed and the air cap has at least one central opening which is bounded by at least one wall. The at least one wall forms a gap with at least one part of the paint nozzle, and a forward part of the paint nozzle has at least an inner face, an outer face and an end face. The end face of the paint nozzle encloses, at least in certain regions, an angle of greater than 90° or an angle of less than 90° with an outer face or an inner face of the paint nozzle. In the nozzle arrangements, the back-pressure counter to the outflow of the material to be sprayed is lower than in prior art nozzles. A spray gun, in particular a paint spray gun, having such a nozzle arrangement is also disclosed.

24 Claims, 2 Drawing Sheets

(58) Field of Classification Search
USPC ..... 239/423, 424, 434.5, 601
See application file for complete search history.

(56) References Cited

U.S. PATENT DOCUMENTS

| | | | |
|---|---|---|---|
| 459,432 | A | 9/1891 | Anderson |
| 459,433 | A | 9/1891 | Avery |
| 548,816 | A | 10/1895 | Paul |
| 552,213 | A | 12/1895 | Troy |
| 552,715 | A | 1/1896 | Lugrin |
| 563,505 | A | 7/1896 | McCornack |
| 581,107 | A | 4/1897 | Emery |
| 644,803 | A | 3/1900 | Justi |
| 672,012 | A | 4/1901 | Ruper |
| 574,880 | A | 5/1901 | Schmidt et al. |
| 1,662,496 | A | 3/1928 | Forsgard |
| 1,703,383 | A | 2/1929 | Birkenmaier |
| 1,703,384 | A | 2/1929 | Birkenmaier |
| 1,711,221 | A | 4/1929 | Blakeslee |
| 1,751,787 | A | 3/1930 | Binks |
| 1,889,201 | A | 11/1932 | Holveck |
| 2,004,303 | A | 6/1935 | Wahlin |
| 2,008,381 | A | 7/1935 | Beeg |
| 2,049,700 | A | 8/1936 | Gustafsson |
| 2,051,210 | A | 8/1936 | Gustafsson |
| 2,070,696 | A | 2/1937 | Tracy |
| 2,116,036 | A | 5/1938 | Money |
| 2,125,445 | A | 8/1938 | Holveck |
| 2,198,441 | A | 4/1940 | Mollart |
| 2,204,599 | A | 6/1940 | Jenkins |
| 2,269,057 | A | 1/1942 | Jenkins |
| D133,223 | S | 7/1942 | Tammen |
| 2,356,865 | A | 8/1944 | Mason |
| 2,416,856 | A | 3/1947 | Thomsen |
| 2,416,923 | A | 3/1947 | Jenkins |
| 2,557,593 | A | 6/1951 | Bjorkman |
| 2,557,606 | A | 6/1951 | Liedberg |
| 2,559,091 | A | 7/1951 | Reasenberg |
| 2,609,961 | A | 9/1952 | Sapien |
| 2,612,899 | A | 10/1952 | Earle |
| 2,646,314 | A | 7/1953 | Peeps |
| 2,721,004 | A | 10/1955 | Schultz |
| 2,743,963 | A | 5/1956 | Peeps |
| 2,844,267 | A | 7/1958 | Petriccione |
| 2,886,252 | A | 5/1959 | Ehrensperger |
| 3,090,530 | A | 5/1963 | Peeps |
| D196,477 | S | 10/1963 | Kelly |
| 3,159,472 | A | 12/1964 | Revell |
| D200,594 | S | 3/1965 | Sass |
| 3,240,398 | A | 3/1966 | Dalton, Jr. |
| D204,306 | S | 4/1966 | Hamm |
| D205,760 | S | 9/1966 | Hocutt et al. |
| D208,903 | S | 10/1967 | Zadron et al. |
| 3,344,992 | A | 10/1967 | Norris |
| 3,381,845 | A | 5/1968 | MacDonald |
| 3,417,650 | A | 12/1968 | Varrin |
| 3,420,106 | A | 1/1969 | Keller et al. |
| 3,435,683 | A | 4/1969 | Keller et al. |
| 3,482,781 | A | 12/1969 | Sharpe |
| D217,928 | S | 6/1970 | Felske |
| 3,524,589 | A | 8/1970 | Pelton, Jr. |
| 3,527,372 | A | 9/1970 | Manning |
| 3,583,632 | A | 6/1971 | Schaffer |
| 3,622,078 | A | 11/1971 | Gronert |
| 3,645,562 | A | 2/1972 | Fandetti et al. |
| 3,656,493 | A | 4/1972 | Black et al. |
| 3,714,967 | A | 2/1973 | Zupan et al. |
| 3,746,253 | A | 7/1973 | Walberg |
| 3,747,850 | A | 7/1973 | Hastings et al. |
| 3,771,539 | A | 11/1973 | De Santis |
| 3,840,143 | A | 10/1974 | Davis et al. |
| 3,848,807 | A | 11/1974 | Partida |
| 3,857,511 | A | 12/1974 | Govindan |
| 3,870,223 | A | 3/1975 | Wyant |
| 3,873,023 | A | 3/1975 | Moss et al. |
| 3,938,739 | A | 2/1976 | Bertilsson et al. |
| 4,000,915 | A | 1/1977 | Strom |
| D245,048 | S | 7/1977 | Pool |
| D252,097 | S | 6/1979 | Probst et al. |
| 4,160,525 | A | 7/1979 | Wagner |
| 4,171,091 | A | 10/1979 | van Hardeveld et al. |
| 4,210,263 | A | 7/1980 | Bos |
| 4,273,293 | A | 6/1981 | Hastings |
| 4,278,276 | A | 7/1981 | Ekman |
| 4,411,387 | A | 10/1983 | Stern et al. |
| 4,478,370 | A | 10/1984 | Hastings |
| D276,472 | S | 11/1984 | Harrison |
| D278,543 | S | 4/1985 | Gintz |
| 4,545,536 | A | 10/1985 | Avidon |
| 4,562,965 | A | 1/1986 | Ihmels et al. |
| 4,572,437 | A | 2/1986 | Huber et al. |
| 4,580,035 | A | 4/1986 | Luscher |
| 4,585,168 | A | 4/1986 | Even et al. |
| 4,614,300 | A | 9/1986 | Falcoff |
| 4,643,330 | A | 2/1987 | Kennedy |
| 4,653,661 | A | 3/1987 | Buchner et al. |
| 4,667,878 | A | 5/1987 | Behr |
| 4,713,257 | A | 12/1987 | Luttermoeller |
| D293,950 | S | 1/1988 | Ogden et al. |
| 4,730,753 | A | 3/1988 | Grime |
| 4,767,057 | A | 8/1988 | Degli |
| D298,372 | S | 11/1988 | Taylor, Jr. |
| 4,784,184 | A | 11/1988 | Gates |
| 4,806,736 | A | 2/1989 | Schirico |
| 4,826,539 | A | 5/1989 | Harpold |
| 4,832,232 | A | 5/1989 | Broccoli |
| 4,863,781 | A | 9/1989 | Kronzer |
| 4,877,144 | A | 10/1989 | Thanisch |
| D305,057 | S | 12/1989 | Morgan |
| 4,887,747 | A | 12/1989 | Ostrowsky et al. |
| 4,901,761 | A | 2/1990 | Taylor |
| 4,906,151 | A | 3/1990 | Kubis |
| 4,917,300 | A | 4/1990 | Gloviak et al. |
| 4,946,075 | A | 8/1990 | Lundback |
| 4,964,361 | A | 10/1990 | Aebersold |
| 4,967,600 | A | 11/1990 | Keller |
| 4,969,603 | A | 11/1990 | Norman |
| 4,973,184 | A | 11/1990 | La Salle |
| D314,421 | S | 2/1991 | Tajima et al. |
| D314,588 | S | 2/1991 | Denham |
| 4,989,787 | A | 2/1991 | Nikkei et al. |
| 5,020,700 | A | 6/1991 | Krzywdziak et al. |
| D318,877 | S | 8/1991 | Miranda et al. |
| 5,042,840 | A | 8/1991 | Rieple et al. |
| D321,597 | S | 11/1991 | Cerny |
| 5,064,119 | A | 11/1991 | Mellette |
| 5,071,074 | A | 12/1991 | Lind |
| 5,074,334 | A | 12/1991 | Onodera |
| 5,078,323 | A | 1/1992 | Frank |
| 5,080,285 | A | 1/1992 | Toth |
| 5,088,648 | A | 2/1992 | Schmon |
| 5,090,623 | A | 2/1992 | Burns et al. |
| 5,102,045 | A | 4/1992 | Diana |
| 5,119,992 | A | 6/1992 | Grime |
| 5,125,391 | A | 6/1992 | Srivastava et al. |
| 5,135,124 | A | 8/1992 | Wobser |
| 5,143,102 | A | 9/1992 | Blaul |
| 5,165,605 | A | 11/1992 | Morita et al. |
| 5,170,941 | A | 12/1992 | Morita et al. |
| 5,190,219 | A | 3/1993 | Copp, Jr. |
| 5,191,797 | A | 3/1993 | Smith |
| 5,209,405 | A | 5/1993 | Robinson et al. |
| 5,228,488 | A | 7/1993 | Fletcher |
| 5,232,299 | A | 8/1993 | Hiss |
| 5,236,128 | A | 8/1993 | Morita et al. |
| 5,249,746 | A | 10/1993 | Kaneko et al. |
| D341,186 | S | 11/1993 | Albers |
| 5,289,974 | A | 3/1994 | Grime et al. |
| 5,322,221 | A | 6/1994 | Anderson |
| 5,325,473 | A | 6/1994 | Monroe et al. |
| 5,332,156 | A | 7/1994 | Wheeler |
| 5,333,506 | A | 8/1994 | Smith et al. |
| 5,333,908 | A | 8/1994 | Dorney et al. |
| 5,344,078 | A | 9/1994 | Fritz et al. |

(56) References Cited

U.S. PATENT DOCUMENTS 5,367,148 A 11/1994 Storch et al.
D353,836 S 12/1994 Carvelli et al.
5,381,962 A 1/1995 Teague
5,435,491 A 7/1995 Sakuma
5,443,642 A 8/1995 Bienduga
5,456,414 A 10/1995 Burns
D365,952 S 1/1996 Gagnon et al.
5,503,439 A 4/1996 LaJeunesse et al.
5,529,245 A 6/1996 Brown
5,533,674 A 7/1996 Feyrer et al.
5,540,385 A 7/1996 Garlick
5,540,386 A 7/1996 Roman
D376,637 S 12/1996 Kieffer
5,582,350 A 12/1996 Kosmyna et al.
5,584,899 A 12/1996 Shorts
5,588,562 A 12/1996 Sander et al.
5,592,597 A 1/1997 Kiss
5,609,302 A 3/1997 Smith
5,613,637 A 3/1997 Schmon
D380,301 S 7/1997 Kogutt
5,655,714 A 8/1997 Kieffer et al.
5,662,444 A 9/1997 Schmidt, Jr.
5,667,143 A 9/1997 Sebion et al.
5,695,125 A 12/1997 Kumar
5,704,381 A 1/1998 Millan et al.
5,718,767 A 2/1998 Crum et al.
D391,403 S 3/1998 Josephs
5,725,161 A 3/1998 Hartle
RE35,769 E 4/1998 Grime et al.
5,755,363 A 5/1998 Gantner et al.
5,762,228 A 6/1998 Morgan et al.
5,803,360 A 9/1998 Spitznagel
5,816,501 A 10/1998 LoPresti et al.
5,836,517 A 11/1998 Burns et al.
D402,820 S 12/1998 Morison et al.
5,843,515 A 12/1998 Crum et al.
5,853,014 A 12/1998 Rosenauer
D405,503 S 2/1999 Edo
5,874,680 A 2/1999 Moore
5,884,006 A 3/1999 Frohlich et al.
D409,719 S 5/1999 Kaneko
5,941,461 A * 8/1999 Akin ..... E21B 10/602 239/418
5,951,190 A 9/1999 Wilson
5,951,296 A 9/1999 Klein
5,954,268 A 9/1999 Joshi et al.
D414,636 S 10/1999 Wiese
5,979,797 A 11/1999 Castellano
5,992,763 A 11/1999 Smith et al.
6,006,930 A 12/1999 Dreyer et al.
6,010,082 A 1/2000 Peterson
6,017,394 A 1/2000 Crum et al.
6,019,294 A 2/2000 Anderson et al.
6,036,109 A 3/2000 DeYoung
6,039,218 A 3/2000 Beck
6,050,499 A * 4/2000 Takayama ..... B05B 3/1064 239/112
6,053,429 A 4/2000 Chang
6,056,213 A 5/2000 Ruta et al.
6,056,215 A * 5/2000 Hansinger ..... B05B 3/1064 239/703
6,089,471 A 7/2000 Scholl
6,089,607 A 7/2000 Keeney et al.
6,091,053 A 7/2000 Aonuma
6,092,740 A 7/2000 Liu
6,132,511 A 10/2000 Crum et al.
D435,379 S 12/2000 Nguyen
6,230,986 B1 5/2001 Vacher et al.
6,250,567 B1 6/2001 Lewis et al.
6,267,301 B1 7/2001 Haruch
6,276,616 B1 8/2001 Jenkins
D448,451 S 9/2001 Turnbull et al.
6,308,991 B1 10/2001 Royer
D457,599 S 5/2002 Karwoski
D459,432 S 6/2002 Schmon
D459,433 S 6/2002 Schmon
6,402,058 B2 6/2002 Kaneko et al.
6,402,062 B1 6/2002 Bending et al.
6,431,466 B1 8/2002 Kitajima
6,435,426 B1 8/2002 Copp, Jr.
6,442,276 B1 8/2002 Doljack
6,450,422 B1 9/2002 Maggio
6,494,387 B1 * 12/2002 Kaneko ..... B05B 7/066 239/296
6,536,684 B1 3/2003 Wei
6,536,687 B1 3/2003 Navis et al.
D472,730 S 4/2003 Sparkowski
6,540,114 B1 4/2003 Popovich et al.
6,543,632 B1 4/2003 McIntyre et al.
6,547,884 B1 4/2003 Crum et al.
6,553,712 B1 4/2003 Majerowski et al.
6,554,009 B1 4/2003 Beijbom et al.
D474,528 S 5/2003 Huang
6,585,173 B2 7/2003 Schmon et al.
6,595,441 B2 7/2003 Petrie et al.
6,612,506 B1 9/2003 Huang
6,626,382 B1 9/2003 Liu
6,626,383 B1 9/2003 Campbell
6,647,997 B2 11/2003 Mohn
6,661,438 B1 12/2003 Shiraishi et al.
D485,685 S 1/2004 Zupkofska et al.
6,675,845 B2 1/2004 Volpenheim et al.
6,692,118 B2 2/2004 Michele et al.
6,712,292 B1 3/2004 Gosis et al.
6,717,584 B2 4/2004 Kulczycka
6,732,751 B2 5/2004 Chiang
6,763,964 B1 7/2004 Hurlbut et al.
6,766,763 B2 7/2004 Crum et al.
6,786,345 B2 9/2004 Richards
6,796,514 B1 9/2004 Schwartz
6,801,211 B2 10/2004 Forsline et al.
6,820,824 B1 11/2004 Joseph et al.
6,843,390 B1 1/2005 Bristor
6,845,924 B2 1/2005 Schmon
6,855,173 B2 2/2005 Ehrnsperger et al.
6,863,310 B1 3/2005 Petkovsek
6,863,920 B2 3/2005 Crum et al.
6,874,656 B2 4/2005 Rohr et al.
6,874,664 B1 4/2005 Montgomery
6,874,708 B2 4/2005 Reetz, III
6,877,677 B2 4/2005 Schmon et al.
6,929,019 B2 8/2005 Weinmann et al.
6,945,429 B2 9/2005 Gosis et al.
6,955,180 B2 10/2005 Kocherlakota et al.
6,962,432 B2 11/2005 Hofeldt
6,963,331 B1 11/2005 Kobayashi et al.
7,017,838 B2 3/2006 Schmon
7,018,154 B2 3/2006 Schmon
D519,687 S 4/2006 Zahav
7,032,839 B2 4/2006 Blette et al.
7,036,752 B1 5/2006 Hsiang
7,083,119 B2 8/2006 Bouic et al.
7,090,148 B2 8/2006 Petrie et al.
7,097,118 B1 8/2006 Huang
D528,192 S 9/2006 Nicholson
7,106,343 B1 9/2006 Hickman
7,165,732 B2 1/2007 Kosmyna et al.
7,172,139 B2 2/2007 Bouic et al.
7,175,110 B2 2/2007 Vicentini
7,182,213 B2 2/2007 King
D538,050 S 3/2007 Tardif
D538,493 S 3/2007 Zimmerle et al.
D538,886 S 3/2007 Huang
7,194,829 B2 3/2007 Boire et al.
D541,053 S 4/2007 Sanders
D541,088 S 4/2007 Nesci
7,201,336 B2 4/2007 Blette et al.
7,216,813 B2 5/2007 Rogers
D545,943 S 7/2007 Rodgers et al.
7,246,713 B2 7/2007 King
7,249,519 B2 7/2007 Rogers
D548,816 S 8/2007 Schmon
7,255,293 B2 8/2007 Dodd
7,264,131 B2 9/2007 Tsutsumi et al.

(56) References Cited

U.S. PATENT DOCUMENTS

D552,213 S 10/2007 Schmon
D552,715 S 10/2007 Schmon
D554,703 S 11/2007 Josephson
D563,505 S 3/2008 Schmon
7,374,111 B2 5/2008 Joseph et al.
D571,463 S 6/2008 Chesnin
7,384,004 B2 6/2008 Rogers
RE40,433 E 7/2008 Sata
D573,227 S 7/2008 Mirazita et al.
D574,926 S 8/2008 Huang
D575,374 S 8/2008 Huang
7,410,106 B2 8/2008 Escoto, Jr. et al.
7,416,140 B2 8/2008 Camilleri et al.
7,422,164 B2 9/2008 Matsumoto
D579,213 S 10/2008 Aipa
D581,107 S 11/2008 Schmon
D581,483 S 11/2008 Bass et al.
D583,013 S 12/2008 Wang
7,458,612 B1 12/2008 Bennett
D588,231 S 3/2009 Pellin
7,533,678 B2 5/2009 Rosa
7,540,434 B2 6/2009 Gohring et al.
7,542,032 B2 6/2009 Kruse
7,568,638 B2 8/2009 Gehrung
D604,394 S 11/2009 Wang
7,614,571 B2 11/2009 Camilleri et al.
D607,086 S 12/2009 Kosaka
7,624,869 B2 12/2009 Primer
D607,972 S 1/2010 Wang
D608,858 S 1/2010 Baltz et al.
D614,731 S 4/2010 Wang
7,694,893 B2 4/2010 Zittel et al.
7,694,896 B2 4/2010 Turnbull et al.
D615,586 S 5/2010 Kudimi
D616,022 S 5/2010 Kudimi
D616,527 S 5/2010 Anderson et al.
7,765,876 B1 8/2010 Chen
D624,668 S 9/2010 Noppe
7,810,744 B2 10/2010 Schmon et al.
7,819,341 B2 10/2010 Schmon et al.
D627,039 S 11/2010 Yu
D627,432 S 11/2010 Escoto et al.
7,823,806 B2 11/2010 Schmon
D629,623 S 12/2010 Lampe
7,856,940 B2 12/2010 Wendler
7,913,938 B2 3/2011 Cooper
7,922,107 B2 4/2011 Fox
D637,269 S 5/2011 Wang
D638,121 S 5/2011 Villasana
D639,863 S 6/2011 Langan
D641,067 S 7/2011 Wang
D644,716 S 9/2011 Gehrung
D644,803 S 9/2011 Schmon
D645,094 S 9/2011 Langan
8,042,402 B2 10/2011 Brown et al.
D649,196 S 11/2011 Langan
8,052,071 B2 11/2011 Kruse
D655,347 S 3/2012 Gehrung
8,127,963 B2 3/2012 Gerson et al.
D657,276 S 4/2012 Brose
D661,492 S 6/2012 Ranschau
D661,742 S 6/2012 Clark
D663,960 S 7/2012 Jeronimo
8,225,892 B2 7/2012 Ben-Tzvi
D664,773 S 8/2012 Papin
8,240,579 B1 8/2012 Bennett
8,297,536 B2 10/2012 Ruda
D670,085 S 11/2012 Brookman
D671,988 S 12/2012 Leipold
D672,012 S 12/2012 Brose
D674,880 S 1/2013 Schmon
8,352,744 B2 1/2013 Kruse
8,360,345 B2 1/2013 Micheli
D681,162 S 4/2013 Kruse
8,444,067 B2 5/2013 Schmon et al.
8,454,759 B2 6/2013 Selsvik
8,481,124 B2 7/2013 Nolte et al.
D689,590 S 9/2013 Brose
D689,593 S 9/2013 Schmon
D690,799 S 10/2013 Maier
D692,530 S 10/2013 Gehrung
D692,532 S 10/2013 Li et al.
8,616,434 B2 12/2013 Wilen
D697,584 S 1/2014 Schmon
D698,008 S 1/2014 Schmon et al.
8,626,674 B2 1/2014 Whitehouse
8,642,131 B2 2/2014 Nolte et al.
D704,300 S 5/2014 Li et al.
8,757,182 B2 6/2014 Schmon
8,807,460 B2 8/2014 Charpie et al.
8,857,732 B2 10/2014 Brose
D720,015 S 12/2014 Kruse
D720,041 S 12/2014 Robinson
8,899,501 B2 12/2014 Fox et al.
D721,785 S 1/2015 Gehrung
8,925,836 B2 1/2015 Dettlaff
D733,369 S 6/2015 Tschan
D733,453 S 7/2015 Tschan
D734,428 S 7/2015 Wang
D734,429 S 7/2015 Wang
D734,571 S 7/2015 Tschan
9,073,068 B2 7/2015 Krayer et al.
D737,126 S 8/2015 Tschan
D740,393 S 10/2015 Gehrung
D745,636 S 12/2015 Lin
9,220,853 B2 12/2015 Vogt
D757,216 S 5/2016 Gherung
D758,533 S 6/2016 Dettlaff
D758,537 S 6/2016 Gehrung
D768,820 S 10/2016 Binz
D770,593 S 11/2016 Gehrung
9,498,788 B2 * 11/2016 Kosaka ..... B05B 7/0815
9,533,317 B2 1/2017 Gehrung et al.
D792,557 S 7/2017 Wang
D794,756 S 8/2017 Wang
9,782,784 B2 10/2017 Schmon et al.
9,878,336 B2 1/2018 Gehrung
D835,235 S 12/2018 Gehrung et al.
10,189,037 B2 1/2019 Schmon et al.
10,464,076 B2 11/2019 Kruse
10,471,449 B2 11/2019 Gehrung
10,702,879 B2 7/2020 Gehrung
2001/0004996 A1 6/2001 Schmon
2001/0040192 A1 11/2001 Kaneko et al.
2002/0134861 A1 9/2002 Petrie et al.
2002/0148501 A1 10/2002 Shieh
2002/0170978 A1 11/2002 Mohn
2003/0025000 A1 2/2003 Schmon et al.
2003/0066218 A1 4/2003 Schweikert
2003/0121476 A1 7/2003 McIntyre et al.
2003/0127046 A1 7/2003 Zehner et al.
2003/0164408 A1 9/2003 Schmon
2003/0173419 A1 9/2003 Huang
2003/0177979 A1 9/2003 Crum et al.
2003/0189105 A1 10/2003 Schmon
2003/0209568 A1 11/2003 Douglas et al.
2003/0213857 A1 11/2003 Schmon et al.
2003/0218596 A1 11/2003 Eschler
2003/0230636 A1 12/2003 Rogers
2004/0046051 A1 3/2004 Cruz et al.
2004/0050432 A1 3/2004 Breda
2004/0104194 A1 6/2004 Dennison
2004/0129738 A1 7/2004 Stukas
2004/0140373 A1 7/2004 Joseph et al.
2004/0155063 A1 8/2004 Hofeldt
2004/0159720 A1 8/2004 Komornicki
2004/0177890 A1 9/2004 Weinmann
2004/0191406 A1 9/2004 Crum et al.
2004/0217201 A1 11/2004 Ruda
2004/0233223 A1 11/2004 Schkolne et al.
2004/0245208 A1 12/2004 Dennison
2005/0056613 A1 3/2005 King
2005/0082249 A1 4/2005 King
2005/0127201 A1 6/2005 Matsumoto

(56) References Cited

U.S. PATENT DOCUMENTS

| | | | |
|---|---|---|---|
| 2005/0145723 | A1 | 7/2005 | Blette et al. |
| 2005/0145724 | A1 | 7/2005 | Blette et al. |
| 2005/0178854 | A1 | 8/2005 | Dodd |
| 2005/0189445 | A1 | 9/2005 | Hartle et al. |
| 2005/0218246 | A1 | 10/2005 | Chatron et al. |
| 2005/0220943 | A1 | 10/2005 | Abrams et al. |
| 2005/0248148 | A1 | 11/2005 | Schenck et al. |
| 2005/0252993 | A1 | 11/2005 | Rogers |
| 2005/0252994 | A1 | 11/2005 | Rogers |
| 2005/0268949 | A1 | 12/2005 | Rosa |
| 2005/0284963 | A1 | 12/2005 | Reedy |
| 2006/0000927 | A1 | 1/2006 | Ruda |
| 2006/0007123 | A1 | 1/2006 | Wilson et al. |
| 2006/0048803 | A1 | 3/2006 | Jessup et al. |
| 2006/0081060 | A1 | 4/2006 | Forster |
| 2006/0113409 | A1 | 6/2006 | Camilleri et al. |
| 2006/0171771 | A1 | 8/2006 | Kruse |
| 2006/0192377 | A1 | 8/2006 | Bauer et al. |
| 2006/0196891 | A1 | 9/2006 | Gerson et al. |
| 2007/0029788 | A1 | 2/2007 | Adler |
| 2007/0055883 | A1 | 3/2007 | Kruse |
| 2007/0131795 | A1 | 6/2007 | Abbate et al. |
| 2007/0158349 | A1 | 7/2007 | Schmon et al. |
| 2007/0205305 | A1 | 9/2007 | Vagedes |
| 2007/0221754 | A1 | 9/2007 | Gehrung |
| 2007/0228190 | A1 | 10/2007 | Tanner |
| 2007/0252378 | A1 | 11/2007 | Chambers |
| 2007/0262169 | A1 | 11/2007 | Wang |
| 2008/0011879 | A1 | 1/2008 | Gerson et al. |
| 2008/0019789 | A1 | 1/2008 | Dunaway et al. |
| 2008/0029619 | A1 | 2/2008 | Gohring et al. |
| 2008/0128533 | A1 | 6/2008 | Gehrung |
| 2008/0179763 | A1 | 7/2008 | Schmon et al. |
| 2008/0251977 | A1 | 10/2008 | Naruse et al. |
| 2008/0264892 | A1 | 10/2008 | Nozawa |
| 2008/0272213 | A1 | 11/2008 | Ting |
| 2008/0296410 | A1 | 12/2008 | Carey et al. |
| 2009/0014557 | A1 | 1/2009 | Schmon et al. |
| 2009/0026290 | A1 | 1/2009 | Fox |
| 2009/0045623 | A1 | 2/2009 | Schmon |
| 2009/0072050 | A1 | 3/2009 | Ruda |
| 2009/0078789 | A1 | 3/2009 | Kruse |
| 2009/0078790 | A1 | 3/2009 | Camilleri et al. |
| 2009/0143745 | A1 | 6/2009 | Langan et al. |
| 2009/0183516 | A1 | 7/2009 | Appler et al. |
| 2009/0235864 | A1 | 9/2009 | Khoury et al. |
| 2009/0266915 | A1 | 10/2009 | Fedorov |
| 2010/0021646 | A1 | 1/2010 | Nolte et al. |
| 2010/0059533 | A1 | 3/2010 | Unger et al. |
| 2010/0084493 | A1 | 4/2010 | Troudt |
| 2010/0108783 | A1 | 5/2010 | Joseph et al. |
| 2010/0126541 | A1 | 5/2010 | Schmon |
| 2010/0163649 | A1 | 7/2010 | Bass et al. |
| 2010/0206963 | A1 | 8/2010 | Huang |
| 2010/0270390 | A1 | 10/2010 | Reitz |
| 2010/0270400 | A1 | 10/2010 | Evar et al. |
| 2011/0024524 | A1 | 2/2011 | Fox |
| 2011/0125607 | A1 | 5/2011 | Wilen |
| 2011/0121103 | A1 | 6/2011 | Carleton et al. |
| 2011/0127767 | A1 | 6/2011 | Wicks et al. |
| 2011/0168811 | A1 | 7/2011 | Fox et al. |
| 2011/0174901 | A1 | 7/2011 | Dettlaff et al. |
| 2012/0012671 | A1 | 1/2012 | Brose et al. |
| 2012/0097762 | A1 | 4/2012 | Gehrung et al. |
| 2012/0132550 | A1 | 5/2012 | Gerson et al. |
| 2012/0160935 | A1 | 6/2012 | Krayer et al. |
| 2012/0187220 | A1 | 7/2012 | Micheli et al. |
| 2013/0056556 | A1 | 3/2013 | Schmon et al. |
| 2013/0074864 | A1 | 3/2013 | Nuzzo et al. |
| 2013/0266734 | A1 | 10/2013 | Nolte et al. |
| 2013/0320110 | A1 | 12/2013 | Brose et al. |
| 2014/0034757 | A1 | 2/2014 | Kaneko et al. |
| 2014/0048627 | A1 | 2/2014 | Schmon et al. |
| 2014/0059905 | A1 | 3/2014 | Raming |
| 2014/0145003 | A1 | 5/2014 | Schmon et al. |
| 2014/0263686 | A1 | 9/2014 | Hedger |
| 2014/0305962 | A1 | 10/2014 | Tschan |
| 2014/0346257 | A1 | 11/2014 | Reetz, III et al. |
| 2015/0165463 | A1 | 6/2015 | Gehrung |
| 2015/0231655 | A1 | 8/2015 | Adams et al. |
| 2016/0030960 | A1 | 2/2016 | Gehrung |
| 2017/0304852 | A1 | 10/2017 | Bierie |
| 2018/0050355 | A1 | 2/2018 | Delsard |
| 2018/0050356 | A1 | 2/2018 | Sata |
| 2018/0050361 | A1 | 2/2018 | Gehrung |
| 2018/0050362 | A1 | 2/2018 | Sata |
| 2018/0133727 | A1 | 5/2018 | Schmon et al. |
| 2018/0200740 | A1 | 7/2018 | Rossbach et al. |
| 2020/0038889 | A1 | 2/2020 | Volk et al. |
| 2020/0038892 | A1 | 2/2020 | Volk et al. |

FOREIGN PATENT DOCUMENTS

| | | | |
|---|---|---|---|
| AT | 250467 | | 10/2003 |
| AT | 322645 | | 4/2006 |
| AT | 383910 | | 2/2008 |
| AT | 461752 | | 4/2010 |
| AT | 461753 | | 4/2010 |
| AT | 475488 | | 8/2010 |
| AU | 637187 | | 5/1993 |
| AU | 2002352235 | | 9/2003 |
| AU | 2004315547 | | 8/2005 |
| AU | 2005205899 | | 8/2005 |
| AU | 2011257605 | | 11/2012 |
| AU | 2011361295 | | 5/2013 |
| CA | 521511 | | 2/1956 |
| CA | 2126957 | | 1/1995 |
| CA | 2277096 | | 7/1998 |
| CA | 2445183 | | 10/2002 |
| CA | 2552390 | | 8/2005 |
| CA | 2555607 | | 8/2005 |
| CA | 2690112 | | 5/2009 |
| CA | 2797990 | | 12/2011 |
| CA | 2812684 | | 9/2012 |
| CA | 102917803 | | 2/2013 |
| CA | 2850401 | A1 | 5/2013 |
| CH | 203 668 | | 6/1939 |
| CH | 542104 | A | 9/1973 |
| CH | 676208 | | 12/1990 |
| CN | 2136077 | Y | 6/1993 |
| CN | 1899704 | A | 1/2007 |
| CN | 1902002 | | 1/2007 |
| CN | 1909970 | | 2/2007 |
| CN | 1909971 | | 2/2007 |
| CN | 1917960 | | 2/2007 |
| CN | 200954482 | | 10/2007 |
| CN | 101125316 | | 2/2008 |
| CN | 201064746 | Y | 5/2008 |
| CN | 100430150 | | 11/2008 |
| CN | 100455360 | | 1/2009 |
| CN | 101367066 | | 2/2009 |
| CN | 100478080 | | 4/2009 |
| CN | 101646500 | | 2/2010 |
| CN | 102211070 | | 4/2011 |
| CN | 102139249 | A | 8/2011 |
| CN | 102211069 | | 10/2011 |
| CN | 103 521 378 | A | 1/2014 |
| CN | 203508251 | U | 4/2014 |
| CN | 203737474 | U | 7/2014 |
| CN | 204074345 | U | 1/2015 |
| CN | 204294401 | U | 4/2015 |
| CN | 105377447 | A | 3/2016 |
| CN | 205966208 | U | 2/2017 |
| CN | 107427851 | A | 12/2017 |
| CN | 108223901 | A | 6/2018 |
| CN | 207493903 | U | 6/2018 |
| DE | 460381 | | 5/1928 |
| DE | 510362 | | 10/1930 |
| DE | 611325 | C | 3/1935 |
| DE | 1425890 | | 11/1968 |
| DE | 2559036 | | 9/1976 |
| DE | 2653981 | | 6/1978 |
| DE | 2950341 | | 7/1980 |
| DE | 2926286 | A1 | 1/1981 |

(56) References Cited

FOREIGN PATENT DOCUMENTS

| | | | |
|---|---|---|---|
| DE | 3016419 | | 11/1981 |
| DE | 8024829.9 | | 9/1982 |
| DE | 3111571 | A1 | 10/1982 |
| DE | 3238149 | A1 | 4/1984 |
| DE | 34 02 097 | | 8/1985 |
| DE | 3402945 | A1 | 8/1985 |
| DE | 3517122 | | 5/1986 |
| DE | 3505618 | | 8/1986 |
| DE | 3526819 | | 2/1987 |
| DE | 3016419 | C2 | 8/1987 |
| DE | 8702559 | | 10/1987 |
| DE | 3708472 | A1 | 10/1988 |
| DE | 8902223 | | 5/1989 |
| DE | 3742308 | | 6/1989 |
| DE | 8905681 | | 11/1989 |
| DE | G 90 01 265 | | 5/1990 |
| DE | 3906219 | | 8/1990 |
| DE | 4302911 | | 8/1993 |
| DE | 4230535 | | 3/1994 |
| DE | G 94 16 015.5 | U1 | 11/1994 |
| DE | 4321940 | | 1/1995 |
| DE | 69211891 | T2 | 10/1996 |
| DE | 19516485 | | 11/1996 |
| DE | 19727884 | | 2/1999 |
| DE | 69505433 | T2 | 4/1999 |
| DE | 19807973 | | 7/1999 |
| DE | 19824264 | | 12/1999 |
| DE | 19832990 | | 1/2000 |
| DE | 20000483 | | 8/2000 |
| DE | 10004105 | | 10/2000 |
| DE | 19958569 | | 2/2001 |
| DE | 199 41 362 | | 3/2001 |
| DE | 199 45 760 | | 3/2001 |
| DE | 19945760 | | 3/2001 |
| DE | 10103221 | A1 | 8/2001 |
| DE | 10031857 | | 1/2002 |
| DE | 10031858 | | 1/2002 |
| DE | 20114257 | | 2/2002 |
| DE | 10059406 | | 6/2002 |
| DE | 10135104 | | 9/2002 |
| DE | 102 05 831 | | 8/2003 |
| DE | 10205831 | | 8/2003 |
| DE | 10311238 | | 10/2004 |
| DE | 10 2004 027 789 | | 2/2005 |
| DE | 29825120 | | 2/2005 |
| DE | 102004027789 | A1 | 2/2005 |
| DE | 69827994 | T2 | 4/2005 |
| DE | 20320781 | | 6/2005 |
| DE | 10 2004 014 646 | | 7/2005 |
| DE | 10 2004 003 438 | | 8/2005 |
| DE | 102004003439 | | 8/2005 |
| DE | 10 2004 007 733 | | 9/2005 |
| DE | 10 2004 021 298 | | 11/2005 |
| DE | 699 28 944 | T2 | 9/2006 |
| DE | 69535077 | T2 | 11/2006 |
| DE | 202007001031 | | 3/2007 |
| DE | 60200500 1173 | | 8/2007 |
| DE | 60206956 | T2 | 8/2008 |
| DE | 102007006547 | | 8/2008 |
| DE | 102007013628 | A1 | 9/2008 |
| DE | 102007039106 | | 2/2009 |
| DE | 102007052067 | | 5/2009 |
| DE | 20 2010 012 449 | U1 | 12/2010 |
| DE | 202010012449 | | 12/2010 |
| DE | 102009032399 | A1 | 1/2011 |
| DE | 102009053449 | | 2/2011 |
| DE | 102010060086 | | 4/2012 |
| DE | 102010056263 | A1 | 6/2012 |
| DE | 102011106060 | | 1/2013 |
| DE | 102011118120 | | 5/2013 |
| DE | 10 2011 120 717 | A1 | 6/2013 |
| DE | 112007001824 | B3 | 7/2013 |
| DE | 10 2012 013 464 | A1 | 11/2013 |
| DE | 10 2015 114202 | A1 | 1/2017 |
| EM | 002066910-0001 | | 3/2013 |
| EM | 002066910-0002 | | 3/2013 |
| EM | 002066910-0003 | | 3/2013 |
| EM | 002066910-0004 | | 3/2013 |
| EM | 002066910-0005 | | 3/2013 |
| EM | 002066910-0006 | | 3/2013 |
| EM | 002066910-0007 | | 3/2013 |
| EM | 002066910-0008 | | 3/2013 |
| EM | 002066910-0009 | | 3/2013 |
| EM | 002066910-0010 | | 3/2013 |
| EP | 0092043 | A2 | 10/1983 |
| EP | 0092392 | | 10/1983 |
| EP | 0114064 | A2 | 7/1984 |
| EP | 0313958 | A2 | 5/1989 |
| EP | 524408 | | 1/1993 |
| EP | 567325 | | 10/1993 |
| EP | 0631821 | | 1/1995 |
| EP | 0650766 | | 5/1995 |
| EP | 0650766 | A2 | 5/1995 |
| EP | 678334 | | 10/1995 |
| EP | 0706832 | | 4/1996 |
| EP | 0706832 | A1 | 4/1996 |
| EP | 0710506 | | 5/1996 |
| EP | 801002 | | 10/1997 |
| EP | 0846498 | A1 | 6/1998 |
| EP | 987060 | | 3/2000 |
| EP | 1081639 | | 3/2001 |
| EP | 1106262 | | 6/2001 |
| EP | 1 247 586 | | 10/2002 |
| EP | 1247586 | | 10/2002 |
| EP | 1277519 | | 1/2003 |
| EP | 1294490 | | 3/2003 |
| EP | 1299194 | | 4/2003 |
| EP | 1366823 | | 12/2003 |
| EP | 1412669 | | 4/2004 |
| EP | 1424135 | | 6/2004 |
| EP | 1477232 | A1 | 11/2004 |
| EP | 1479447 | A1 | 11/2004 |
| EP | 1504823 | A1 | 2/2005 |
| EP | 1563913 | | 8/2005 |
| EP | 1574262 | | 9/2005 |
| EP | 1602412 | | 12/2005 |
| EP | 1658902 | A1 | 5/2006 |
| EP | 1708822 | | 10/2006 |
| EP | 1708823 | | 10/2006 |
| EP | 1718415 | | 11/2006 |
| EP | 1880771 | A1 | 1/2008 |
| EP | 1902766 | A1 | 3/2008 |
| EP | 1902786 | | 3/2008 |
| EP | 1902876 | | 3/2008 |
| EP | 1930084 | | 6/2008 |
| EP | 1964616 | | 9/2008 |
| EP | 1964616 | A2 | 9/2008 |
| EP | 1987886 | A2 | 11/2008 |
| EP | 1997561 | A2 | 12/2008 |
| EP | 2017010 | A2 | 1/2009 |
| EP | 2027931 | | 2/2009 |
| EP | 2092987 | A1 | 8/2009 |
| EP | 2106298 | | 10/2009 |
| EP | 2111920 | | 10/2009 |
| EP | 2451586 | A1 | 5/2012 |
| EP | 2490819 | | 8/2012 |
| EP | 2576079 | | 4/2013 |
| EP | 2608890 | | 7/2013 |
| EP | 2 669 213 | A1 | 12/2013 |
| EP | 2703089 | A1 | 3/2014 |
| EP | 2 828 000 | A1 | 1/2015 |
| EP | 3184177 | A1 | 6/2017 |
| FR | 398333 | | 6/1909 |
| FR | 789762 | | 11/1935 |
| FR | 1410519 | | 9/1964 |
| FR | 2444501 | | 7/1980 |
| FR | 2462200 | A1 | 2/1981 |
| FR | 2 570 140 | | 3/1986 |
| FR | 2 774 928 | | 8/1999 |
| FR | 2863512 | A1 | 6/2005 |
| FR | 2927824 | A1 | 8/2009 |
| GB | 190900523 | | 6/1909 |
| GB | 657854 | A | 9/1951 |
| GB | 2 132 916 | | 7/1984 |

(56) References Cited

FOREIGN PATENT DOCUMENTS

| | | | |
|---|---|---|---|
| GB | 2153260 | | 8/1985 |
| GB | 2372465 | | 8/2002 |
| GB | 2411235 | | 8/2005 |
| GB | 2416141 | A | 1/2006 |
| GB | 2444909 | A | 6/2008 |
| HK | 1100405 | | 6/2009 |
| HK | 1096057 | | 7/2009 |
| HK | 1125067 | | 8/2012 |
| HK | 1138533 | | 11/2012 |
| JP | S49-136868 | U | 11/1974 |
| JP | S55-107258 | U | 7/1980 |
| JP | S5654328 | | 5/1981 |
| JP | S57-75246 | | 5/1982 |
| JP | S57128346 | A | 8/1982 |
| JP | 58-119862 | | 5/1983 |
| JP | S5998757 | | 6/1984 |
| JP | S601722 | | 1/1985 |
| JP | S62160156 | A | 7/1987 |
| JP | H01-87805 | | 6/1989 |
| JP | H02258076 | A | 10/1990 |
| JP | H04-176352 | A | 6/1992 |
| JP | H0530749 | | 4/1993 |
| JP | H05172678 | | 7/1993 |
| JP | 674850 | | 3/1994 |
| JP | H06215741 | | 8/1994 |
| JP | H07204542 | A | 8/1995 |
| JP | H08196950 | | 8/1996 |
| JP | H08196950 | A | 8/1996 |
| JP | H09117697 | | 5/1997 |
| JP | 11-047643 | A | 2/1999 |
| JP | 2000015150 | A | 1/2000 |
| JP | 2000070780 | A | 3/2000 |
| JP | 2001259487 | | 9/2001 |
| JP | 2003042882 | | 2/2002 |
| JP | 2003088780 | | 3/2003 |
| JP | 2004-501763 | A | 1/2004 |
| JP | 2004017044 | | 1/2004 |
| JP | 2005000735 | A | 1/2005 |
| JP | 2005138885 | | 6/2005 |
| JP | 2007516831 | | 6/2007 |
| JP | 2008018296 | A | 1/2008 |
| JP | 2010-528837 | A | 8/2010 |
| JP | 2014124274 | A | 7/2014 |
| KR | 2014 0064644 | A | 5/2014 |
| RU | 2523816 | C1 | 1/2014 |
| TW | 491092 | | 6/2002 |
| TW | 510253 | U | 11/2002 |
| TW | I220392 | | 8/2004 |
| TW | I303587 | | 12/2008 |
| TW | I309584 | | 5/2009 |
| WO | 90/008456 | | 8/1990 |
| WO | 91/16610 | | 10/1991 |
| WO | 1992/07346 | | 4/1992 |
| WO | 9522409 | | 8/1995 |
| WO | 1998/32539 | | 7/1998 |
| WO | 01/012337 | | 2/2001 |
| WO | 2001/12337 | | 2/2001 |
| WO | 0166261 | | 9/2001 |
| WO | 01/099062 | | 12/2001 |
| WO | 02/000355 | | 1/2002 |
| WO | 0202242 | | 1/2002 |
| WO | 02/018061 | | 3/2002 |
| WO | 02/085533 | | 10/2002 |
| WO | 03/007252 | | 1/2003 |
| WO | 03/045575 | | 6/2003 |
| WO | 03/069208 | | 8/2003 |
| WO | 03069208 | A1 | 8/2003 |
| WO | 04/037433 | | 5/2004 |
| WO | 2004/37433 | | 5/2004 |
| WO | 04/052552 | | 6/2004 |
| WO | 05/018815 | | 3/2005 |
| WO | 05/068220 | | 7/2005 |
| WO | 05/070557 | | 8/2005 |
| WO | 05/070558 | | 8/2005 |
| WO | 05/077543 | | 8/2005 |
| WO | 05/115631 | | 12/2005 |
| WO | 2006065850 | | 6/2006 |
| WO | 07/128127 | | 11/2007 |
| WO | 2007133386 | A2 | 11/2007 |
| WO | 2007/149760 | A2 | 12/2007 |
| WO | 2009015260 | | 1/2009 |
| WO | 2009015260 | A2 | 1/2009 |
| WO | 2009/054986 | A1 | 4/2009 |
| WO | 2009056424 | | 5/2009 |
| WO | 2010019274 | A1 | 2/2010 |
| WO | 2010/044864 | A1 | 4/2010 |
| WO | 2011047876 | | 4/2011 |
| WO | 2011147555 | | 12/2011 |
| WO | 2012119664 | | 9/2012 |
| WO | 2013000524 | | 1/2013 |
| WO | 2013016474 | | 1/2013 |
| WO | 2013/131626 | A1 | 9/2013 |
| WO | 2013/142045 | A1 | 9/2013 |

OTHER PUBLICATIONS

Notice of Non-Compliant Amendment dated Aug. 10, 2015 for U.S. Appl. No. 13/698,417.
Final Office Action dated Oct. 16, 2015 for U.S. Appl. No. 13/698,417.
Extended European Search Report dated Apr. 17, 2015 for European Application No. 14004167.4.
International Search Report dated Aug. 31, 2016 for PCT/EP2016/061057 filed May 18, 2016.
Written Opinion for PCT/EP2016/061057 filed May 18, 2016.
Office Action from U.S. Appl. No. 15/143,698 dated Jan. 5, 2017.
German Search Report for German Application No. 10 2015 016 474.0 dated Aug. 9, 2016, 14 pages.
Notice of Allowance in U.S. Appl. No. 29/556,463, filed Mar. 1, 2016, 9 pages.
Notice of Allowance in U.S. Appl. No. 29/555,656, filed Feb. 24, 2016, 5 pages.
Final Office Action in U.S. Appl. No. 14/113,649 dated Jun. 22, 2017.
Response filed in U.S. Appl. No. 15/143,698 dated Jul. 3, 2017.
U.S. Appl. No. 14/815,210 Office Action dated Apr. 3, 2018.
U.S. Appl. No. 14/113,649 Response filed Mar. 3, 2018.
German Search Report dated Apr. 10, 2018 for Application No. 10 2017 118 599.2.
Notification of the First Office Action with search report dated Aug. 24, 2015 for Chinese Application No. 201280020519.5 (related to U.S. Appl. No. 14/113,649), 13 pages.
Notification of the Second Office Action dated May 16, 2016, for Chinese Application No. 201280020519.5 (related to U.S. Appl. No. 14/113,649), 5 pages.
Japanese Office Action for JP2014-517485 (related to U.S. Appl. No. 14/113,649), dated Jul. 5, 2016, 16 pages.
Office Action dated Feb. 19, 2016 for U.S. Appl. No. 14/113,649.
Final Office Action dated Feb. 25, 2016 for U.S. Appl. No. 13/698,417.
Restriction Requirement dated Mar. 25, 2016 for Design U.S. Appl. No. 29/516,082.
Response filed Mar. 31, 2016 to Office Action dated Dec. 31, 2016 for U.S. Appl. No. 14/572,998.
Response filed May 28, 2019 for U.S. Appl. No. 15/379,972.
Final Office Action for U.S. Appl. No. 15/679,461 dated Jun. 11, 2019.
Final Office Action for U.S. Appl. No. 15/679,533 dated Jul. 12, 2019.
Printout from Internet www.ehow.com explaining how to choose a spray gun and stating in item 2 "Nozzle sizes vary between about 1 mm and 2 mm.", printed Sep. 7, 2012 (Exhibit 1023 in IPR 2013-0111).
Printout from Internet www.bodyshopbusiness.com explaining how to choose nozzle setup in paragraph bridging pp. 1 and 2, giving general rule of thumb of nozzle sizes from 1.3 mm to 2.2 mm, depending on material being sprayed, printed Sep. 7, 12 (Exhibit 1024 in IPR 2013-0111).
Printout from Internet of pages from brochure of Walther Pilot showing nozzle sizes for spray guns ranging from 0.3 mm to 2.5 mm, dated 2007, (Exhibit 1025 in IPR 2013-0111).

(56) References Cited

OTHER PUBLICATIONS

Printout from Internet www.alsacorp.com showing in the paragraph bridging pp. 2 and 3, Model VS-7200 Saber LVLP spray gun with nozzle size 1.3 mm with sizes 1.3 to 2.0 available, printed Aug. 26, 2012 (Exhibit 1026 in IPR 2013-0111).
Printout from Internet of p. 28 from current 3Mtm brochure showing Tip/Nozzle/Air Cap Selection Guide with nozzle sizes from 0.5 mm to 3.0 mm., (Exhibit 1027 in IPR 2013-0111).
Decision by EPO regarding opposition proceedings to revoke patent No. 99926841.0-2425/ 1108476, corresponding to '387 patent, 2012, (Exhibit 1029 in IPR 2013-0111).
SATA News Publication Dan-Am Jul.-Sep. 1996, (Exhibit 1034 in IPR 2013-0111).
SATA News Publication Dan-Am Oct.-Dec. 1996, (Exhibit 1035 in IPR 2013-0111).
SATA News Publication Dan-Am Apr.-Jun. 1998 (Exhibit 1036 in IPR 2013-0111).
Dan-Am SATA Catalog 6 for spray guns 1991 (Exhibit 1037 in IPR 2013-0111).
Dan-Am SATA Catalog 8 for spray guns 1994 (Exhibit 1038 in IPR 2013-0111).
Dan-Am Catalog 6-51pp published 1991, (Exhibit 1042 in IPR 2013-0111).
Japanese Industrial Standards B 9809 English translation, 1992 (Exhibit 1049 in IPR 2013-0111).
Japanese Industrial Standards B 9809 revised Mar. 1, 1991 (Exhibit 1050 in IPR 2013-0111).
SATA News, vol. 21, 2009 (Exhibit 2010 in IPR 2013-0111).
Collision Hub TV Document (image from video clip) printed Oct. 9, 2013 (Exhibit 2011 in IPR 2013-0111).
MyRielsMe.com document from press release printed Oct. 9, 2013 (Exhibit 2012 in IPR 2013-0111).
Howto set Air pressure, Utube screenshot printed Oct. 9, 2013 (Exhibit 2013 in IPR 2013-0111).
Ohio EPA Letty to Tony Larimer, response to letter dated Aug. 2006 (Exhibit 2014 in IPR 2013-0111).
Pinahs Ben-Tzvi et al, A conceptual design . . . , Mechatrronics 17 (2007) p. 1-13 (Exhibit 2015 in IPR 2013-0111).
On line ad from Amazon.com printed Oct. 14, 2013 (Exhibit 2017 in IPR 2013-0111).
Rone et al, MEMS-Baed Microdroplet Generation with Integrated Sensing, COMSOL, 2011 (Exhibit 2018 in IPR 2013-0111).
International Search Report dated Jul. 14, 2016 for International Application No. PCT/EP2016/000809, filed May 17, 2016.
Written Opinion for International Application No. PCT/EP2016/000809, filed May 17, 2016.
German Search Report dated Apr. 21, 2017 for application No. 10 2016 009 957.7.
Response to Office Action filed Feb. 16, 2016 for U.S. Appl. No. 13/698,417.
Screen shot of a SATA product (SATAjet B) description retrieved on Feb. 12, 2016 from www.sata.com/index.php.
"The Hot Rolling Process;" California Steel; retrieved on Feb. 12, 2016 from http://www.californiasteel.com/GetPublicFile.aspx?id=53.
Response to Office Action dated Apr. 5, 2019 for U.S. Appl. No. 15/679,461 (29 pages).
Response to Office Action dated Apr. 9, 2019 for U.S. Appl. No. 15/679,533 (22 pages).
International Preliminary Report on Patentability for PCT/EP2015/001728 filed Aug. 25, 2015.
Final Office Action dated Mar. 16, 2017 from U.S. Appl. No. 13/698,417, 9 pages.
Written Opinion dated Sep. 8, 2016 for International Application No. PCT/EP2016/061057 filed May 18, 2016.
Office Action dated Jan. 25, 2019, for U.S. Appl. No. 15/379,972.
Office Action, dated Jan. 9, 2019, for U.S. Appl. No. 15/679,482.
German Search Report dated Mar. 18, 2016 for Application No. 20 2015 003 664.3, 5 pages.
Chinese Search Report dated Feb. 21, 2019 for Application No. 2016800293781, 3 pages.
Final Office Action dated Sep. 12, 2018 in U.S. Appl. No. 14/815,210.
European Search Report dated Jan. 24, 2018 for U.S. Appl. No. 17/186,905.
Restriction Requirement Office Action dated Aug. 28, 2018 in U.S. Appl. No. 15/679,533.
Restriction Requirement Office Action dated Aug. 28, 2018 in U.S. Appl. No. 15/679,461.
Notice of Allowance dated Sep. 14, 2018 in U.S. Appl. No. 29/618,945.
Notice of Allowance dated Sep. 14, 2018 in U.S. Appl. No. 14/113,649.
Second Chinese Office Action dated Jun. 24, 2015 for Chinese Application No. 2011800266029.
Third Chinese Office Action dated Nov. 30, 2015 for Chinese Application No. 2011800266029.
Final Office Action dated Aug. 29, 2016 for U.S. Appl. No. 14/113,649.
Office Action dated Nov. 2, 2016 for U.S. Appl. No. 11/949,122.
Response restriction requirement filed May 23, 2016 for Design U.S. Appl. No. 29/516,082.
Office Action dated Jun. 30, 2017 for U.S. Appl. No. 14/815,210.
Japanese Office Action dated Sep. 25, 2019 for Japanese Publication No. 2015-149405, 4 pages.
Office Action dated Aug. 7, 2015 for U.S. Appl. No. 13/991,285.
Response to Restriction Requirement filed Jul. 27, 2015 to Restriction Requirement dated May 27, 2015 for U.S. Appl. No. 13/991,285.
Application filed Jul. 31, 2015 for U.S. Appl. No. 14/815,210.
Final Office Action dated Aug. 4, 2015 for U.S. Appl. No. 13/380,949.
Notice of Allowance dated Aug. 3, 2015 for U.S. Appl. No. 29/486,232.
Office Action dated Dec. 31, 2015 for U.S. Appl. No. 14/572,998.
Notice of Allowance dated Jan. 19, 2016 for Design U.S. Appl. No. 29/539,615.
Notice of Allowance dated Jan. 22, 2016 for U.S. Appl. No. 13/991,285.
European Search Report dated May 8, 2017 for Application No. EP16203544.
"Spray Guns/sata.com", Oct. 18, 2015, XP055364928 URL:http://web.archive.org/web/20151018205307/http://www.sata.com/index.php?id=lackierpistolen&L=11 [gefunden am Apr. 13, 2017]; reprinted on Dec. 8, 2017.
"SATAjet 5000 B Lackierpistolen | Bechersysteme | Atemschutz | Filtertechnik | Zubehor So flexibel wie Ihre Aufgaben" Apr. 11, 2017, XP055364477 Gefunden im Internet: URL:https/www.sata.com/uploads/tx_pxspecialcontent/00_SATAjet_5000_B.pdf [gefunden am Apr. 12, 2017]; English translation of full brochure attached.
Amendments submitted to European Patent Office on Dec. 3, 2017 for Application No. EP16203544 (with English translation of chart on p. 3).
German Search Report for Application No. 10 2016 009 957.7 dated Apr. 21, 2017.
Canadian Office Action dated Nov. 21, 2012 for related application CA2741703.
Chinese Search Report dated Dec. 5, 2012 for related application CN200980135429.9.
Chinese Office Action dated Dec. 13, 2012 for related application CN200980135429.9.
German Search Report for DE 20 2008 014 389.6 completed Jul. 13, 2009.
Restriction Requirement Office Action dated Apr. 17, 2017 for U.S. Appl. No. 14/815,210.
Notice of Allowance dated Apr. 10, 2017 for U.S. Appl. No. 29/579,824.
Response to Final Office Action filed May 9, 2017 in U.S. Appl. No. 13/698,417.
Response to Office Action filed May 17, 2017 in U.S. Appl. No. 14/113,649.
RCE Reply filed Oct. 11, 2019 for U.S. Appl. No. 15/679,461.
Search Report dated Feb. 22, 2019 for German Patent Application No. 10 2018 118 738.6.

(56) References Cited

OTHER PUBLICATIONS

Search Report dated Feb. 8, 2019 for German Patent Application No. 10 2018 118 737.8.
Notice of Allowance dated Jul. 1, 2019 for U.S. Appl. No. 15/379,972.
Notice of Allowance dated Jul. 9, 2019 for U.S. Appl. No. 15/679,482.
Office Action, dated Jan. 15, 2019, for U.S. Appl. No. 15/679,533.
Office Action, dated Jan. 15, 2019, for U.S. Appl. No. 15/679,461.
Response to Election of Species Requirement and Amendment filed Oct. 15, 2018 from U.S. Appl. No. 15/679,482.
Chinese Search Report dated Jul. 18, 2018 for Application No. 2014103745834 filed Jul. 31, 2014.
DesignView of CN302452159 registered Jun. 5, 2013, printed Oct. 18, 2018.
Restriction Requirement dated Mar. 18, 2019, for U.S. Appl. No. 29/596,869.
Office Action dated Mar. 15, 2019, for U.S. Appl. No. 14/815,210.
Notice of Allowance dated Jan. 27, 2016 for Design U.S. Appl. No. 29/510,723.
Notice of Allowance dated Apr. 18, 2016 for U.S. Appl. No. 14/572,998.
Response filed Apr. 27, 2016 to Office Action dated Jan. 29, 2016 for U.S. Appl. No. 13/380,949.
German Search Report dated Apr. 12, 2016 for related German Application No. 10 2015 008 735.5.
May 22, 2018 Final Office Action for U.S. Appl. No. 14/113,649.
Jun. 25, 2018 Response to Office Action for U.S. Appl. No. 14/815,210.
Final Office Action dated Aug. 12, 2019 from U.S. Appl. No. 14/815,210.
International Search Report, Written Opinion and International Preliminary Report on Patentability for PCT/EP2004/005381 file May 19, 2004.
International Search Report, Written Opinion and International Preliminary Report on Patentability for PCT/EP2004/011998 filed Oct. 23, 2004.
International Search Report, Written Opinion and International Preliminary Reporton Patentability for PCT/EP2005/000435 filed Jan. 18, 2005.
International Search Report, Written Opinion and International Preliminary Reporton Patentability for PCT/EP2005/00437 filed Jan. 18, 2005.
International Search Report, Written Opinion and International Preliminary Reporton Patentability for PCT/EP2008/063344, filed Oct. 6, 2008.
International Search Report, Written Opinion and International Preliminary Report on Patentability for PCT/EP2010/002392 filed Apr. 20, 2010.
International Search Report, Written Opinion and International Preliminary Report on Patentability for PCT/EP2011/002544 filed May 21, 2011.
International Search Report, Written Opinion and International Preliminary Report on Patentability for PCT/EP2011/066665 filed Sep. 26, 2011.
International Search Report, Written Opinion and International Preliminary Report on Patentability for PCT/EP2010/003399 filed Jun. 7, 2010.
International Search Report, Written Opinion and International Preliminary Report on Patentability for PCT/EP2011/5842 filed Dec. 2, 2010.
International Search Report, Written Opinion and International Preliminary Report on Patentability for PCT/EP2012/01939 filed May 5, 2012.
International Search Report, Written Opinion and International Preliminary Report on Patentability for PCT/EP2009/06992 filed Sep. 29, 2009.
Internet Archive Wayback Machine [online] [captured Sep. 25, 2012] [retrieved on Sep. 8, 2014] retrieved from the Internet URL:http://web.archive.org/web/20120925210554/http://www.sata.com/index.php?id=sal-check&no cache=1&L=11.
JP Office Action issued against JP Patent App. 2012-508926 dated Feb. 25, 2014 with English translation.
International Search Report (dated Jun. 20, 2008), Written Opinion (dated Jun. 20, 2008), and International Preliminary Report on Patentability (dated Sep. 14, 2010) from PCT/US2008/03318 filed Mar. 12, 2008.
Response filed Dec. 7, 2015 to Office Action dated Aug. 7, 2015 for U.S. Appl. No. 13/991,285.
Office Action dated Nov. 18, 2014 for U.S. Appl. No. 14/113,649.
Notice of Allowance dated Nov. 19, 2014 for U.S. Appl. No. 29/486,223.
Office Action dated Dec. 31, 2014 for U.S. Appl. No. 13/380,949.
Restriction Requirement dated Jan. 9, 2015 for Design U.S. Appl. No. 29/469,049.
Response to Office Action filed Dec. 2, 2014 for U.S. Appl. No. 29/487,679.
Notice of Allowance dated Jan. 15, 2015 for Design U.S. Appl. No. 29/490,620.
Office Action dated Jan. 14, 2015 for Design U.S. Appl. No. 29/447,887.
Hercules Paint Gun Washers brochure publish date Jan. 2012, [online], [site visited Jan. 7, 2015], <http://www.herkules.us/pdfs/L00761-Hercules-Gun_Washers-4-page-brochure.pdf>.
Jetclean GUn Cleaner Terry's Auto Supply, google publish date Aug. 4, 2011, [online], [site visited Jan. 7, 2015], <http://secure.terrys.net/viewProduct. php?productID=FT.FHAZ1005>.
Restriction Requirement dated Feb. 6, 2015 for Design U.S. Appl. No. 29/486,232.
Office Action dated Mar. 30, 2015 for U.S. Appl. No. 13/698,417.
Responde to Office Action filed Apr. 14, 2015 to Office Action dated Jan. 14, 2015 for U.S. Appl. No. 29/447,887.
Response filed Jul. 20, 2015 for Office Action dated Mar. 30, 2015 for U.S. Appl. No. 13/698,417.
Notice of Allowance dated Apr. 30, 2015 for U.S. Appl. No. 29/447,887.
Chinese Office Action dated Oct. 28, 2014 and Search Report dated Oct. 15, 2014 for Chinese Application No. 2011800266029.
Australian Examination Report dated Oct. 30, 2012 for Australian Application No. 2010268870.
Notice of Allowance dated Apr. 24, 2015 for Design U.S. Appl. No. 29/486,232.
Restriction Requirement dated Jan. 22, 2015 for U.S. Appl. No. 13/698,417.
Response filed Mar. 23, 2015 to Restriction Requirement dated Jan. 22, 2015 for U.S. Appl. No. 13/698,417.
Response filed Apr. 6, 2015 to Office Action dated Feb. 6, 2015 for Design U.S. Appl. No. 29/486,232.
Response filed Mar. 31, 2015 to Office Action dated Dec. 31, 2014 for U.S. Appl. No. 13/380,949.
Japanese Office Action dated Jun. 11,2014 for Japanese Patent Application No. 2012-518769.
Australian Examination Report dated Nov. 11, 2014 for Australian patent Application No. 2011257605.
Japanese Notice of Allowance mailed Jan. 13, 2015 for Japanese Patent Application No. 2012/518769.
Application filed Dec. 11, 2011 for U.S. Appl. No. 13/380,949.
Chinese Office Action dated Jan. 28, 2014 and Search Report dated Jan. 21, 2014 for Chinese Application No. 201080030935.4.
Search Report dated Apr. 24, 2010 for German Application No. 10 2009 032 399.6-51.
Application filed Oct. 24, 2013 for U.S. Appl. No. 14/113,649.
Response filed May 18, 2015 to Office Action dated Nov. 18, 2014 for U.S. Appl. No. 14/113,649.
Application filed Dec. 17, 2014 for U.S. Appl. No. 14/572,998.
German Search Report dated Mar. 25, 2014 for German Application No. 202013105779-7.
Application filed Nov. 16, 2012 for U.S. Appl. No. 13/698,417.
Application filed Jun. 2, 2013 for U.S. Appl. No. 13/991,285.
English translation of application filed Aug. 13, 2013 for Application filed Jun. 2, 2013 for U.S. Appl. No. 13/991,285.
Restriction Requirement dated May 27, 2015 for U.S. Appl. No. 13/991,285.
Application filed Jan. 29, 2015 for Design U.S. Appl. No. 29/516,073.

(56) References Cited

OTHER PUBLICATIONS

Application filed Jan. 29, 2015 for Design U.S. Appl. No. 29/516,082.
Application filed Mar. 3, 2015, 2015 for Design U.S. Appl. No. 29/519,198.
Final Office Action dated Jul. 20, 2015 for U.S. Appl. No. 14/113,649.
Final Office Action dated Dec. 7, 2017 for U.S. Appl. No. 14/815,210.
Response to Final Office Action and RCE dated Nov. 29, 2016 in U.S. Appl. No. 14/113,649.
Response filed Dec. 21, 2015 to Office Action dated Jul. 20, 2015 for U.S. Appl. No. 14/113,649.
Response to Office Action dated Jun. 25, 2018 for U.S. Appl. No. 14/815,210.
Response to Final Office Action dated Aug. 22, 2018 for U.S. Appl. No. 14/113,649.
Response to Restriction Requirement filed in U.S. Appl. No. 14/815,210 dated Jun. 19, 2017.
European Search Report, dated Jan. 20, 2020, for European U.S. Appl. No. 19/183,380.
Response to Final Office Action dated Nov. 11, 2019 for U.S. Appl. No. 14/815,210 20 pages.
European Search Report dated Feb. 21, 2020 for Application No. 19183382.1.
Office Action dated Mar. 30, 2020 for U.S. Appl. No. 15/679,533.
Response to Office Action dated Mar. 9, 2020 for U.S. Appl. No. 14/815,210.
Notice of Allowance for U.S. Appl. No. 14/815,210 dated Mar. 25, 2020.
Office Action of U.S. Appl. No. 15/679,461 dated Mar. 31, 2020.
Notice of Allowance dated Sep. 17, 2020 for U.S. Appl. No. 15/679,461.
Restriction/Species requirement dated Dec. 7, 2020 for U.S. Appl. No. 16/524,838.
Final Office Action dated Sep. 4, 2020 for U.S. Appl. No. 15/679,533.
Chinese Search Report for Application No. 2017107135569 dated Aug. 24, 2020 and English translation.
International Search Report dated Apr. 12, 2019 for PCT/DE2018/100679 filed Aug. 1, 2018.
Written Opinion for PCT/DE2018/100679 filed Aug. 1, 2018.
For U.S. Appl. No. 15/679,533: Interview Summary dated Jun. 17, 2020 Response to Office Action, filed Jun. 30, 2020.

* cited by examiner

NOZZLE ARRANGEMENT FOR A SPRAY GUN

FIELD OF THE INVENTION

The invention relates to a nozzle arrangement for a spray gun, in particular a paint spray gun; and to a spray gun, in particular a paint spray gun.

BACKGROUND

A nozzle arrangement according to the prior art is disclosed, for example, in the German utility model publication G 94 16 015.5. Said nozzle arrangement is composed substantially of a paint nozzle which by way of an external thread is screw-fitted into a nozzle insert of a paint spray gun. The paint nozzle is surrounded by an air cap which with the aid of an air nozzle ring is screw-fitted to an external thread of the nozzle insert. The external thread of the paint nozzle for screw-fitting into the nozzle insert is adjoined by a central part of a larger diameter, said central part for receiving a paint needle being hollow inside and, on the rear side thereof that faces the external thread has an annular depression. A plurality of identical bores, in the exemplary embodiment shown six identical bores, which are axially parallel and are disposed on a circle about the nozzle longitudinal axis extend from this depression. The nozzle arrangement disclosed in the utility model mentioned furthermore has an air-deflection disk which causes the compressed air flow to be homogenized. Ahead of this air-deflection disk the paint nozzle both on the internal side thereof as well as on the external side thereof has a plurality of faces which in relation to the nozzle longitudinal axis are disposed at dissimilar angles. The front most region of the paint nozzle is formed by a hollow-cylindrical plug which across the profile thereof has a substantially constant internal diameter and a substantially constant external diameter, said plug forming the outlet for the material to be sprayed. The front end face of the plug is substantially perpendicular to the side wall of the plug. It is known in the prior art that the front end of the paint nozzle can be flush with, or lie ahead of or behind the front wall of the air cap about the central opening, or be flush with, or lie ahead of or behind the front end of the central opening. When the spray gun is not in use, the outlet opening is closed from the inside by the paint needle. The paint needle is moved out of the opening only once the trigger is sufficiently activated and releases said opening for the material to be sprayed, the latter then being able to exit the paint nozzle.

An air cap which in the assembled state surrounds the paint nozzle has a central opening, the diameter of the latter being larger than the external diameter of the paint nozzle plug. The central opening of the air cap and the plug of the paint nozzle conjointly form an annular gap. The so-called atomizing air exits from this annular gap, said atomizing air in the nozzle arrangement described above generating a vacuum on the end face, on account of which the material to be sprayed is suctioned from the paint nozzle. The atomizing air meets the paint jet, on account of which the paint jet is shredded to form threads and strings. Said threads and strings, by virtue of the hydrodynamic instability and aerodynamic disturbances thereof, disintegrate so as to form droplets which are blown away from the nozzle by the atomizing air.

The air cap furthermore has two horns which are diametrically opposed and in the outflow direction project beyond the annular gap mentioned and the material outlet opening. Two supply bores run from the rear side of the air cap to exit holes in the horns. Each horn typically has at least one exit hole, but each horn preferably has at least two exit holes. The holes are oriented such that said holes in the exit direction point to the nozzle longitudinal axis behind the annular gap such that the so-called horn air that exits the holes can influence the air that has already exited the annular gap, or the paint jet, or the already at least partially created paint mist, respectively. On account thereof, the originally conical cross section of the paint jet, or of the paint mist, respectively, is compressed on the sides thereof that face the horns and is elongated in the direction that is perpendicular thereto. A so-called wide jet which permits a higher operating rate is created on account thereof. Apart from deforming the paint jet, the horn air has the purpose of further atomizing the paint jet.

So-called control openings can be incorporated in the front face of the air cap, so as to be radially outside the central opening. Said control openings are preferably disposed on a line between the two horns. The air exiting the control openings influences the horn air, in particular weakening the impact of the horn air on the paint jet. The control air furthermore protects the air cap against contamination in that said control air blows paint droplets away from the air cap. Moreover, said control air contributes toward further atomizing of the paint mist and toward transporting the paint mist in the direction of the object to be coated.

Such a nozzle arrangement is above all suitable for use with a spray gun, in particular a paint spray gun, wherein not only paints but also adhesives or lacquers, in particular base and clear lacquers, both solvent-based as well as water-based, but likewise liquids for the food industry, wood-treatment agents, or other liquids may be sprayed. Spray guns can be classified in particular as hand-held spray guns and as automatic or robotic guns, respectively. Hand-held spray guns are used above all by tradesmen, in particular by painters, joiners and varnishers. Automatic and robotic guns are typically used in conjunction with a painting robot or a painting machine for industrial applications. However, it is readily conceivable for a hand-held spray gun also to be integrated in a painting robot or in a painting machine.

The spray gun may have the following in particular: a grip, an upper gun body, a compressed-air connector, a trigger for opening an air valve and for moving the paint needle out of the material outlet opening, a round/wide jet regulator for setting the ratio of atomizing air to horn air in order for the paint jet to be shaped, an air micrometer for setting the spray pressure, a material-amount regulator for setting the maximum volumetric material flow, a material connector, paint ducts for conducting the material to be sprayed from a material inlet to the material outlet, compressed-air ducts, in particular round-jet ducts for supplying the horns with air, and wide-jet ducts for supplying the annular gap and the control openings with air, a suspension hook, and an analog or digital pressure-measuring installation. However, said spray gun can also have other components from the prior art. The paint spray gun can be designed as a flow-cup spray gun, having a paint cup that is disposed above the gun body and from which the material to be sprayed flows substantially by way of gravity into and through the paint ducts. However, the spray gun can also be a side-cup gun in which the paint cup is disposed laterally on the gun body, and in which the material is likewise infed to the gun by gravity. However, the spray gun can also be as a suction-cup gun, having a paint cup that is disposed below the gun body, from which the material to be sprayed is suctioned substantially by negative pressure, in particular while utilizing the Venturi effect, from the cup. Furthermore, said spray gun can be designed as a pressurized-cup gun in which the cup is disposed below, above, or laterally on the gun body and is impinged with pressure, whereupon the medium to be sprayed is squeezed out of the cup. Furthermore, said spray gun can be a bucket gun in which the material to be sprayed is infed to the spray gun from a paint container by means of a hose.

The nozzle arrangement and the spray gun described above have proven successful for many years. However, design embodiments of this type do display shortcomings when spraying materials with a comparatively high viscosity. By virtue of the plug on the paint nozzle the atomizing air exits the annular gap so as to be substantially parallel with the paint jet, which is why the shear forces which are generated on the paint jet that exits the paint nozzle by the atomizing air are insufficient in order for the paint jet, and in particular the material in the center of the jet, to be sufficiently atomized. This results in an excessively coarse paint mist having paint droplets of excessive size, leading to a coating of poor quality.

One solution to this problem would be to increase the air pressure of the atomizing air, which however can lead to an increase in terms of over spraying, that is to say to a lower application efficiency, and to air entrapment and foam formation in the coating.

Therefore, paint nozzles in which the front part has a conical external face without a plug are used for spray pistols according to the prior art. The atomizing air meets the paint jet at an angle of preferably 30° to 45°. High shear forces can be generated herein even at relatively low air pressures of the atomizing air; the atomizing air is able to penetrate the paint jet to a great depth.

However, in the case of such conical nozzles it has proven disadvantageous that the atomizing air that flows along the conical external wall of the paint nozzle does not generate any vacuum on the front end of the paint nozzle, by way of which vacuum the material to be atomized would be suctioned from the paint nozzle, the atomizing air rather generating a positive pressure which counteracts the spray material exiting from the paint nozzle. Therefore, the pressure at which the spray material exits the paint nozzle must be higher than the pressure at which the atomizing air counteracts the paint jet. For this reason, conical nozzles are employed practically exclusively in the case of pressure-fed guns, in particular pressurized-cup guns and bucket guns.

However, the latter have the above-mentioned disadvantages; furthermore the latter are of a more complicated construction and thus more expensive to produce and more complicated to handle than flow-cup, suction-cup, or side-cup guns. Furthermore, said pressure-fed guns have a higher weight which in the case of hand-held spray guns lead to more rapid fatigue of the user and to diminished agility.

SUMMARY OF THE INVENTION

One aspect of the present invention provides a nozzle arrangement for a spray gun, in particular a paint spray gun, and a spray gun, in particular a paint spray gun, by way of which materials with even a comparatively high viscosity can be atomized to a finer degree, but by way of which the material to be sprayed does not have to be supplied to the spray gun under additional pressure. In an embodiment, this is achieved by a nozzle arrangement, having at least one paint nozzle and one air cap, wherein the paint nozzle has at least one outlet opening for the material to be sprayed, wherein the air cap has at least one central opening which is delimited by at least one wall, wherein the at least one wall conjointly with at least part of the paint nozzle forms a gap and wherein a front part of the paint nozzle has at least one internal face, one external face and one end face, characterized in that the end face of the paint nozzle in relation to an external face of the paint nozzle at least in portions encloses an angle of more than 90°.

This object is achieved by a nozzle arrangement, having at least one paint nozzle and one air cap, wherein the paint nozzle has at least one outlet opening for the material to be sprayed, wherein the air cap has at least one central opening which is delimited by at least one wall, wherein the at least one wall conjointly with at least part of the paint nozzle forms a gap and wherein a front part of the paint nozzle has at least one internal face, one external face and one end face, characterized in that the end face of the paint nozzle in relation to an external face of the paint nozzle at least in portions encloses an angle of more than 90°.

On account thereof, the atomizing air if at all is not deflected too intensely in the direction of the outlet of the paint nozzle, but is largely directed onward in the spraying direction. The region of the end face which in relation to an external face of the paint nozzle encloses an angle of more than 90° in particular can be a region that is adjacent to the external face of the paint nozzle, wherein the transition can be formed by a chamfer or a radius.

In another embodiment, this is achieved by a nozzle arrangement, having at least one paint nozzle and one air cap, wherein the paint nozzle has at least one outlet opening for the material to be sprayed, wherein the air cap has at least one central opening which is delimited by at least one wall, wherein the at least one wall conjointly with at least part of the paint nozzle forms a gap and wherein a front part of the paint nozzle has at least one internal face, one external face and one end face, characterized in that the end face of the paint nozzle in relation to an external face of the paint nozzle at least in portions encloses an angle of less than 90°.

On account thereof, the outlet of the paint nozzle is at least in part shielded by the atomizing air, which is why the atomizing air if at all generates a lower pressure counter to the outflow of the paint jet. Here too, the region of the end face which in relation to an external face of the paint nozzle encloses an angle of more than 90° in particular can be a region that is adjacent to the external face of the paint nozzle, wherein the transition can be formed by a chamfer or a radius.

In another embodiment, this is likewise achieved by a nozzle arrangement for a spray gun, in particular a paint spray gun, having at least one paint nozzle and one air cap, wherein the paint nozzle has at least one outlet opening for the material to be sprayed, wherein the air cap has at least one central opening which is delimited by at least one wall, wherein the at least one wall conjointly with at least part of the paint nozzle forms a gap and wherein a front part of the paint nozzle has at least one internal face, one external face and one end face, characterized in that the end face of the paint nozzle in relation to an internal face of the paint nozzle at least in portions encloses an angle of more than 90°.

The outlet of the paint nozzle is thus also at least in part shielded by the atomizing air. The explanations above apply hereto in an analogous manner.

In another embodiment, this is moreover achieved by a nozzle arrangement for a spray gun, in particular a paint spray gun, having at least one paint nozzle and one air cap, wherein the paint nozzle has at least one outlet opening for the material to be sprayed, wherein the air cap has at least one central opening which is delimited by at least one wall, wherein the at least one wall conjointly with at least part of the paint nozzle forms a gap and wherein a front part of the paint nozzle has at least one internal face, one external face and one end face, characterized in that the end face of the paint nozzle in relation to an internal face of the paint nozzle at least in portions encloses an angle of less than 90°.

As is the case in the above-mentioned nozzle arrangement, the atomizing air here if at all is aslo not deflected so intensely in the direction of the outlet of the paint nozzle but rather is largely directed onward in the spraying direction. The explanations above apply hereto in an analogous manner.

In another embodiment, this is furthermore achieved by a nozzle arrangement which has at least one paint nozzle and one air cap, wherein the paint nozzle has at least one outlet opening for the material to be sprayed, wherein the air cap has at least one central opening which is delimited by at least one wall, wherein the at least one wall conjointly with at least part of the paint nozzle forms a gap, characterized in that the paint nozzle at the front end thereof has a substantially hollow-cylindrical plug, and wherein the air cap has an internal face which is adjacent to the wall that delimits the central opening of the air cap and which is disposed on that side of the wall that faces away from the spraying direction, characterized in that an imaginary straight line which runs parallel with the internal face of the air cap and intersects the paint nozzle longitudinal axis does not intersect the hollow-cylindrical plug.

The imaginary straight line can run parallel with both the internal face of the air cap as well as the external face of the paint nozzle, should these two faces be mutually parallel. On account of the design embodiment mentioned, part of the atomizing air can act directly on the paint jet without being deflected by the plug. Other parts of the air flow are deflected by the plug and on the end face of the latter create a vacuum for suctioning the material to be sprayed out of the outlet opening of the paint nozzle, or flow in the spraying direction and transport the paint jet, or the paint mist, respectively, in the direction of the object to be coated.

Advantageous design embodiments are also disclosed.

The "front part of the paint nozzle" is at all times to be understood to be that part of the paint nozzle that faces the spraying direction.

The external face of the paint nozzle in a front region can be disposed so as to be substantially parallel with the internal face of the paint nozzle, that is to say that the paint nozzle in this region has a constant wall thickness. The front region herein can be designed so as to be hollow-cylindrical in the form of a plug, or be designed so as to be conical. The external face of the paint nozzle in a front region in relation to the internal face of the paint nozzle can however also be disposed at an angle of more than 0° and less than 90°. The external face herein can be designed so as to be cylindrical, and the internal face can be designed so as to be conical, such that the interior of the paint nozzle tapers or widens in the spraying direction. However, the internal face of the paint nozzle can also be cylindrical, and the external diameter of the paint nozzle can become larger or smaller in the spraying direction. In the case of the latter, the internal face of the paint nozzle in a front region advantageously runs so as to be substantially parallel with the paint nozzle longitudinal axis. The interior of the paint nozzle can however in a front region also taper or widen in the spraying direction.

The end face of the paint nozzle in relation to an internal face of the paint nozzle at least in regions can enclose an angle of more than 90° or less than 90°. The above-mentioned effects, specifically shielding the material outlet of the paint nozzle, or directing the atomizing air in the spraying direction, respectively, can also be achieved on account thereof. Furthermore, the region of the end face which in relation to an internal face of the paint nozzle encloses an angle of less than or more than 90° can also herein be in particular a region which is adjacent to the internal face of the paint nozzle, wherein the transition can be formed by a chamfer or by a radius.

The end face of the paint nozzle can be assembled from at least two faces which in relation to the external face of the paint nozzle enclose dissimilar angles. The end face at least in part can also be designed so as to be concave, convex, or S-shaped. The same applies to the internal and the external face of the paint nozzle. Guiding of the atomizing air jet and of the paint jet is possible in a homogenous and targeted manner on account thereof.

The wall that delimits the central opening of the air cap is advantageously disposed so as to be at least in part substantially parallel with the external face of the paint nozzle. However, said wall in a region that faces away from the spraying direction can also have a spacing from the external face of the paint nozzle that is larger or smaller than in a region that faces the spraying direction. The wall can also be designed so as to be convex or concave at least in regions.

The paint nozzle advantageously has at least one duct for conducting air. This air by the ducts mentioned is directed from the air ducts in the gun body, or from the air distribution ring, respectively, to the air cap.

The nozzle arrangement according to the invention preferably has an air-deflection disk for homogenizing the pressure conditions, said air-deflection disk preferably being disposed ahead of the just-mentioned ducts in the paint nozzle. The air that flows from the ducts is deflected and homogenized on account thereof.

The air cap preferably has at least two horns each having at least one horn air opening, wherein the horns are diametrically opposed and in the spraying direction project beyond the annular gap mentioned and the material outlet opening. The horn air openings can have dissimilar diameters, shapes, and alignments in relation to the horns and to the paint nozzle longitudinal axis, and can be designed as inserts. All openings can be of identical design; however the openings that in each case are diametrically opposed are advantageously of identical design but in terms of, for example, the diameter thereof and the alignment thereof are dissimilar to the other openings that are in each case diametrically opposed.

The air cap in at least one region between the central opening and the horns can have control ducts for exhausting air. The control ducts direct the air from the interior of the air cap to the outside. Said control ducts can be in a straight line between the two horns, but can also be disposed beside this line. The control ducts herein in the assembled state of the paint nozzle and the air cap can be at least in regions disposed so as to be substantially parallel with the paint nozzle longitudinal axis.

However, said control ducts can also completely or in regions face the paint nozzle longitudinal axis or face away from the latter. This applies in particular to the outlet end of the control ducts. If the outlet ends face the paint nozzle longitudinal axis, the air flowing out of the control ducts can be conjointly used for atomizing. If the control ducts face away from the paint nozzle longitudinal axis and are aligned toward the horn air flow, said control ducts can be used for weakening the horn air, on account of which the risk of the paint jet being split by the horn air is reduced. The control ducts can have arbitrary shapes and sizes, and can be disposed at any angle in relation to the paint nozzle longitudinal axis. Said control ducts can also be designed as inserts. All control ducts can be of identical design, but can also be at least in part designed so as to be dissimilar. The control ducts can in each case also be assembled from a plurality of ducts. For example, two bores which can also be mutually oblique can form one control duct. One of the bores, in particular a blind bore, herein can be incorporated in the air cap from the rear side of the latter, and another bore can be incorporated from the front side, for example. Both bores meet in the interior of the air cap wall.

Furthermore, the nozzle arrangement according to the invention can of course also have other components or design embodiments according to the prior art.

The spray gun, in particular the paint spray gun, according to the invention is characterized in that said spray gun has a nozzle arrangement as previously disclosed.

The spray gun can advantageously have a hollow needle which can be designed for conducting material for spraying or compressed air. For example, a higher throughput of material, or spraying of bi-component material, is possible by way of a hollow needle that conducts material for spraying. To this end, the hollow needle is connected directly or indirectly to a supply of material. If and when the hollow needle is designed so as to conduct compressed air, said needle by way of expelling atomizing air may contribute toward atomizing the material for spraying. To this end, the hollow needle is connected directly or indirectly to a supply of compressed air. In all cases, the hollow needle can be designed for conducting an arbitrary volumetric flow. A person skilled in the art will be familiar with the fact that the throughput depends on the internal diameter of the hollow needle and on the input pressure and the volumetric flow.

Furthermore, the spray gun according to the invention can of course also have other components or design embodiments according to the prior art, for example a round jet/wide jet regulator by means of which arbitrary ratios in terms of the atomizing and horn air pressure and arbitrary ratios in terms of the atomizing and horn air volumetric flow can be adjusted. A pressurized cup which by virtue of the nozzle arrangement according to the invention can be impinged by way of a lower pressure than in the case of nozzle arrangements according to the prior art can also be applied in order for the atomizing output to be increased.

BRIEF DESCRIPTION OF THE DRAWINGS

The invention will be explained in more detail hereunder in an exemplary manner by means of eleven drawings in which.

DETAILED DESCRIPTION OF THE INVENTION

Figure 1:
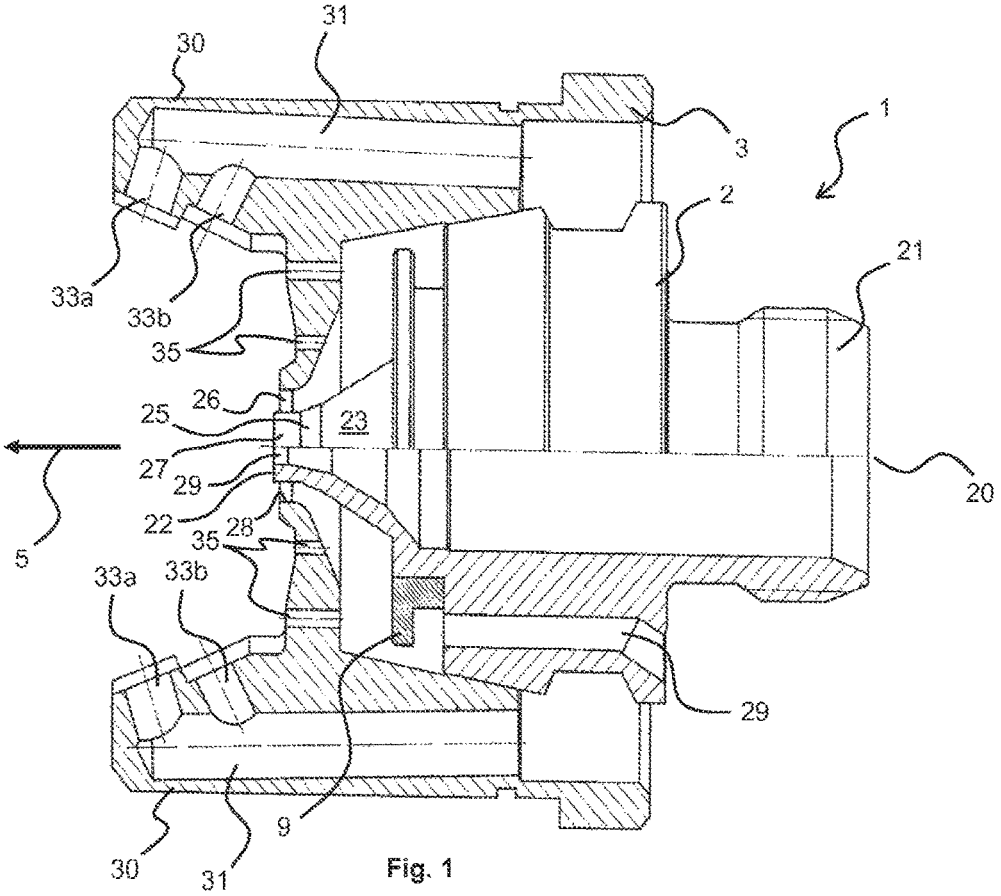
FIG. 1 shows a nozzle arrangement according to the prior art, in a partial sectional view.

FIG. 1 shows a nozzle arrangement 1 according to the prior art, having a paint nozzle 2 and an air cap 3. The paint nozzle 2 by way of an external thread 21 is screw-fitted into a nozzle insert of a paint spray gun (not shown in FIG. 1). The air cap 3 with the aid of an air nozzle ring (not shown in FIG. 1) is screw-fitted to an external thread of the nozzle insert. The external thread 21 of the paint nozzle 2 for screw-fitting the nozzle insert is adjoined by a central part having a larger diameter, said central part for receiving a paint needle (not shown in FIG. 1) being hollow inside and on the rear side thereof that faces the external thread having an annular depression. A plurality of identical bores 29, in the exemplary embodiment shown six identical bores 29, which are axially parallel and are disposed on a circle about the nozzle longitudinal axis extend from this depression. The nozzle arrangement 1 disclosed in FIG. 1 furthermore has an air deflection disk 9 which causes the compressed air flow to be homogenized. Ahead of this air-deflection disk 9 the paint nozzle 2 both on the internal side thereof as well as on the external side thereof has a plurality of faces which in relation to the nozzle longitudinal axis are disposed at dissimilar angles. The front most region of the paint nozzle is formed by a hollow-cylindrical plug 27 which across the profile thereof has a substantially constant internal diameter and a substantially constant external diameter, said plug 27 forming the outlet 29 for the material to be sprayed. The front end face 22 of the plug 27 is substantially perpendicular to the side wall of the plug. When the spray gun is not in use, the outlet opening 29 is closed from the inside by a paint needle. The paint needle is moved out of the opening only once the trigger is sufficiently activated and releases said opening for the material to be sprayed, the latter then being able to exit the paint nozzle 2 or the outlet opening 29 of the latter, respectively.

An air cap 3 which in the assembled state surrounds the paint nozzle 2 has a central opening, the diameter of the latter being larger than the external diameter of the paint nozzle plug. It is known in the prior art that the front end of the paint nozzle 2 can be flush with, or lie ahead of or behind the front wall of the air cap 3 about the central opening, or be flush with, or lie ahead of or behind the front end of the central opening, respectively. The central opening of the air cap 3 and the plug of the paint nozzle 2 conjointly form an annular gap 26. The so-called atomizing air exits from this annular gap 26, said atomizing air in the nozzle arrangement described above generating a vacuum on the end face 22 of the paint nozzle 2, on account of which the material to be sprayed is suctioned from the paint nozzle 2. The atomizing air meets the paint jet, on account of which the paint jet is shredded to form threads and strings. Said threads and strings, by virtue of the hydrodynamic instability and aerodynamic disturbances thereof, disintegrate so as to form droplets which are blown away from the nozzle by the atomizing air.

The air cap 3 furthermore has two horns 30 which are diametrically opposed and in the spraying direction 5 project beyond the annular gap 26 mentioned and the material outlet opening 29. Two supply bores 31 run from the rear side of the air cap 3 to exit holes 33*a*, 33*b* in the horns 30. Each horn typically has at least one exit hole, but each horn preferably has at least two exit holes. The holes 33*a*, 33*b* are oriented such that said holes 33*a*, 33*b* in the exit direction 5 point to the nozzle longitudinal axis 20 behind the annular gap 26 such that the so-called horn air that exits the holes 33*a*, 33*b* can influence the air that has already exited the annular gap 26, or the paint jet, or the already at least partially created paint mist, respectively. On account thereof, the originally conical cross section of the paint jet, or of the paint mist, respectively, is compressed on the sides thereof that face the horns 30 and is elongated in the direction that is perpendicular thereto. A so-called wide jet which permits a higher operating rate is created on account thereof. Apart from deforming the paint jet, the horn air has the purpose of further atomizing the paint jet.

So-called control openings 35 can be incorporated in the front face of the air cap 3, so as to be radially outside the central opening. Said control openings 35 are preferably disposed on a line between the two horns 30. The air exiting the control openings 35 influences the horn air, in particular weakening the impact of the horn air on the paint jet. The control air furthermore protects the air cap 3 against contamination in that said control air blows paint droplets away from the air cap 3. Moreover, said control air contributes toward further atomizing of the paint mist and toward transporting the paint mist in the direction of the object to be coated.

The invention will be explained in more detail by means of a plurality of exemplary embodiments in the drawings hereunder. Those parts of the nozzles which in the figures are shown in a sectional view are designed in a rotationally symmetrical manner. The lower part of the drawing therefore mirrors the upper part along the longitudinal axis. For reasons of space, the reference signs have therefore only been entered on one side of the longitudinal axis.

Alternatively, the nozzles can also be designed so as to be elongate or square.

The spraying direction that in FIG. 1 is identified by the reference sign 5 also applies to drawings 2 to 11.

Figure 2:
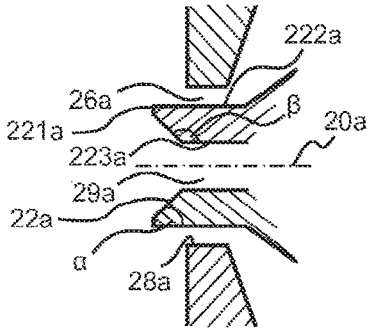
FIG. 2 shows a detail of a first exemplary embodiment of a nozzle arrangement according to the invention, in a sectional view.

FIG. 2 shows a first exemplary embodiment of a nozzle arrangement according to the invention, wherein only the relevant fragment of the nozzle arrangement is illustrated. The internal face 223*a* of the paint nozzle in the present exemplary embodiment is substantially parallel with the external face 222*a* of the paint nozzle. The end face 22*a* in relation to the external face 222*a* of the paint nozzle encloses an angle α of less than 90°. At the same time, the end face 22*a* in relation to the internal face 223*a* of the paint nozzle encloses an angle β of more than 90°. The wall 28*a* that delimits the central opening of the air cap is substantially parallel with the external face 222*a*, the internal face 223*a*, and the longitudinal axis 20*a* of the paint nozzle. The wall 28*a* that delimits the central opening of the air cap, conjointly with the external face 222*a* of the paint nozzle, forms a gap 26*a*. The end face 22*a* in the present case is composed of only one face which is adjacent to the external face 222*a* of the paint nozzle. There is only a chamfer 221*a* between the two faces. Said chamfer 221*a* is advantageous since a sharp-edged nozzle tip can lead to injuries and is more prone to damage than a nozzle tip having a chamfer or a radius. In principle, all edges can be slightly beveled or rounded. All chamfers illustrated in the figures can also represent larger faces. The present design embodiment of the nozzle arrangement has the advantage that the outlet opening 29*a* of the paint nozzle is shielded by the air exiting from the gap 26*a*.

Figure 3:
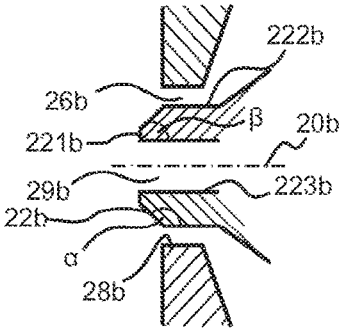
FIG. 3 shows a detail of a second exemplary embodiment of a nozzle arrangement according to the invention, in a sectional view.

FIG. 3 shows an exemplary embodiment of the nozzle arrangement according to the invention, in which the angle α between the external face 222*b* and the end face 22*b* of the paint nozzle is more than 90°, the angle β between the internal face 223*b* and the end face 22*b* being less than 90°. A chamfer 221*b* forms the front end of the paint nozzle. However, a further chamfer or radius can also be provided between the external face 222*b* and the end face 22*b* of the paint nozzle. The wall 28*b* that delimits the central opening of the air cap, the external face 222*b* of the paint nozzle, and the internal face 223*b* of the paint nozzle here too are substantially parallel with the paint nozzle longitudinal axis 20*b*. Here too, the wall 28*b* that delimits the central opening of the air cap, conjointly with the external face 222*b* of the paint nozzle, forms a gap 26*b*. It is advantageous in this second exemplary embodiment that the atomizing air, immediately upon exiting the gap 26*b*, cannot expand in the direction of the outlet 29*b* of the paint nozzle, as would be the case with a paint nozzle having an end face that is perpendicular to the external wall, but that the atomizing air from the end face 22*b* is guided onward in the spraying direction. The air flow, also on account of the Coandă effect, follows the transition from the external face 222*b* to the end face 22*b*. The air meets the paint jet and atomizes the latter. The chamfer 221*b* can also be designed as a larger face on which the atomizing air can generate a vacuum on account of which the material to be sprayed is suctioned from the outlet opening 29*b*.

Figure 4:
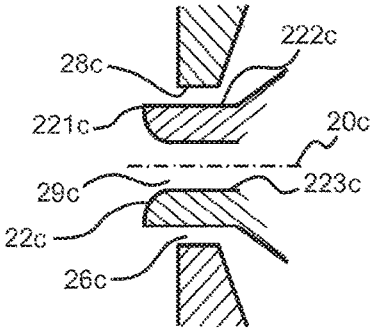
FIG. 4 shows a detail of a third exemplary embodiment of a nozzle arrangement according to the invention, in a sectional view.

An exemplary embodiment of the nozzle arrangement according to the invention having an end face 22*c* in a convex design is shown in FIG. 4, wherein the angle between the end face 22*c* and the external face 222*c* of the paint nozzle is less than 90°. In the case of curved end faces, the angle between the end face and the external face of the paint nozzle is defined as the angle between the tangent to the end face and the external face of the paint nozzle, or as the angle between a straight line from the starting point to the ending point of the curvature and the external face of the paint nozzle. The wall 28*c* that delimits the central opening of the air cap, the external face 222*c* of the paint nozzle, and the internal face 223*c* of the paint nozzle, here too, are substantially parallel with the paint nozzle longitudinal axis 20*c*. Here too, the wall 28*c* that delimits the central opening of the air cap, conjointly with the external face 222*c* of the paint nozzle, forms a gap 26*c*. It is advantageous in this embodiment that the paint jet that exits the outlet opening 29*c* can spread uniformly along the end face 22*c*. The chamfer 221*c* can also be designed as a larger face on which the atomizing air can generate a vacuum by way of which the material to be sprayed is suctioned from the outlet opening 29*c*.

Figure 5:
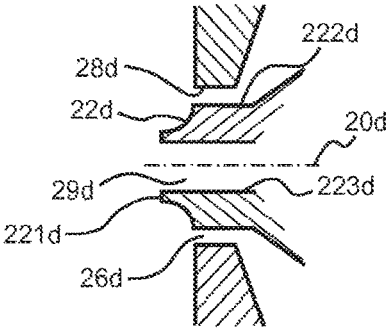
FIG. 5 shows a detail of a fourth exemplary embodiment of a nozzle arrangement according to the invention, in a sectional view.

FIG. 5 shows a type of spoiler nozzle, the end face of the latter being formed by a concave face 22*d* and by a straight face or a chamfer 221*d*. The air that flows from the gap 26*d*, on account of the Coandă effect, follows the curvature and is directed in the spraying direction. The front, thin part of the paint nozzle can also be designed so as to be shorter such that the atomizing air on account of the curvature is directed more intensely in the direction of the paint nozzle longitudinal axis 20*d*, on account of which said atomizing air can act more intensely on the paint jet. If the chamfer 221*d* is designed as a larger face, the atomizing air thereon can generate a vacuum by way of which the material to be sprayed is suctioned from the outlet opening 29*d*.

The nozzle arrangements illustrated in FIGS. 2 to 5 indeed all show a paint nozzle having a plug, that is a front part having an internal face and an external face running parallel with the paint nozzle longitudinal axis; however, the design embodiments mentioned above can also be applied to conical nozzles.

Figure 6:
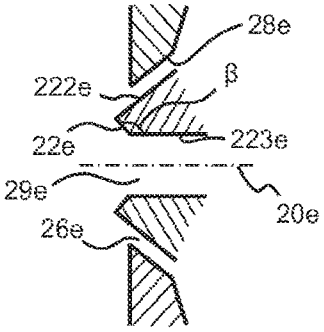
FIG. 6 shows a detail of a fifth exemplary embodiment of a nozzle arrangement according to the invention, in a sectional view.

A paint nozzle having a conical external face 222*e* is shown in FIG. 6. The wall 28*e* that delimits the central opening of the air cap here is substantially parallel with the external face 222*e*. The end face 22*e* here is approximately perpendicular to the external face 222*e*, the angle β between the internal face 223*e* and the end face 22*e* being more than 90°. However, in particular the angle between the end face 22*e* and the external face 222*e* can be more than or less than 90°. Of course, transitions between faces herein can also be formed by a chamfer or a radius.

Figure 7:
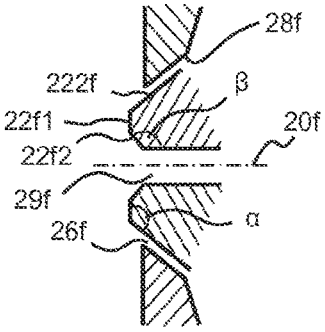
FIG. 7 shows a detail of a sixth exemplary embodiment of a nozzle arrangement according to the invention, in a sectional view.

The nozzle arrangement shown in FIG. 7 likewise has a paint nozzle having a conical external face 222*f*. The end face here is composed of two faces 22*f*1, 22*f*2, which are disposed at dissimilar angles in relation to the paint nozzle longitudinal axis. Both the angle α between the internal face and the end face, as well as the angle β between the external face and the end face, are more than 90°. The end face in relation to the internal face and in relation to the external face of the paint nozzle thus at least in regions encloses an angle of more than 90°.

Figure 8:
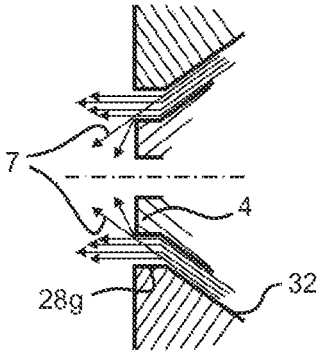
FIG. 8 shows a detail of a seventh exemplary embodiment of a nozzle arrangement according to the invention, in a sectional view.

FIG. 8 shows a nozzle arrangement according to the invention, having a wall 28*g* that delimits the central opening, a substantially hollow-cylindrical plug 4, and an internal face 32 that is adjacent to the wall 28*g*. An imaginary straight line 7 which runs so as to be parallel with the internal face 32 of the air cap and intersects the paint nozzle longitudinal axis does not intersect the hollow-cylindrical plug. The imaginary straight line in FIG. 8 is parallel with both the internal face of the air cap as well as with the external face of the paint nozzle. On account of the design embodiment shown, part of the atomizing air (symbolized by the arrows) can act directly on the paint jet without being deflected by the plug. This part of the atomizing air runs in a manner approximately identical to that of the straight line 7. Other parts of the air flow are deflected by the plug and on the end face of the latter generate a vacuum for suctioning the material to be sprayed from the outlet opening of the paint nozzle, or flow in the spraying direction and transport the paint jet or the paint mist, respectively, in the direction of the object to be coated.

Figure 9:
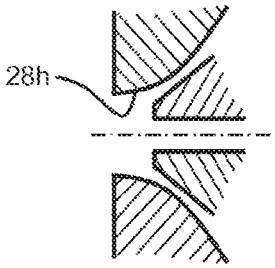
FIG. 9 shows a detail of an eighth exemplary embodiment of a nozzle arrangement according to the invention, in a sectional view.

A nozzle arrangement having an air cap wall 28*h* in a convex design is illustrated in FIG. 9.

Figure 10:
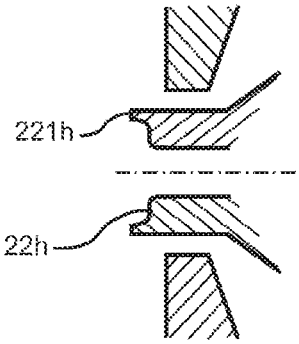
FIG. 10 shows a detail of a ninth exemplary embodiment of a nozzle arrangement according to the invention, in a sectional view.

The nozzle arrangement shown in FIG. 10 has a paint nozzle having a substantially S-shaped end face 22*h* and chamfer or face 221*h*.

Figure 11:
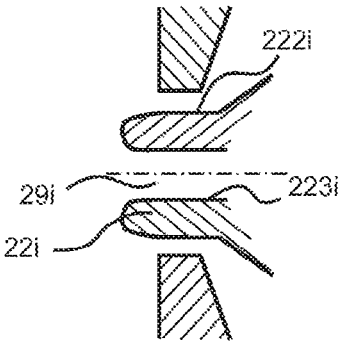
FIG. 11 shows a detail of a tenth exemplary embodiment of a nozzle arrangement according to the invention, in a sectional view.

FIG. 11 shows a paint nozzle having a rounded end face 22*i*, wherein the rounding here on the external face 222*i* in the spraying direction commences ahead of the rounding on the internal face 223*i*. The end face 223*i* in relation to the external face 222*i* thus encloses an angle of more than 90°, the end face 223*i* in relation to the internal face 223*i* enclosing an angle of less than 90°.

In the case of all exemplary embodiments mentioned, the pressure counter to the outflow of the material to be sprayed is lower than in the case of nozzle according to the prior art.

The drawings illustrated are to be understood as merely not-to-scale diagrams, and the exemplary embodiments are to be understood as merely exemplary. The thickness of the paint nozzle walls and the thickness of the wall that delimits the central opening of the air cap can vary, as can the projections of the paint nozzle beyond the front end of the air cap, the internal diameter and the external diameter of the paint nozzle, the size of the chamfers and radii, and the spacings between the paint nozzle and the air cap, in particular the spacings between the paint nozzle and the wall that delimits the central opening of the air cap. All design embodiments of end faces shown can be employed in the case of both paint nozzles with plugs, as well as paint nozzles without plugs, that is to say in which at least a front region is designed so as to be conical.

The invention claimed is:

1. A nozzle arrangement for a paint spray gun comprising:

a paint nozzle; and one air cap, wherein the paint spray gun is a compressed air paint spray gun in which air atomizes a material to be sprayed, wherein the paint nozzle has at least one outlet opening for the material to be sprayed, wherein the air cap has at least one central opening which is delimited by at least one wall, wherein a front part of the paint nozzle has at least one internal face, one external face, and one end face that is adjacent to the external face, wherein the at least one wall conjointly with a portion of the external face of the paint nozzle forms a gap in the radial direction, wherein the end face of the paint nozzle in relation to the portion of the external face of the paint nozzle that forms the gap at least in portions encloses an angle of more than 90°, wherein a portion of the end face of the paint nozzle is concave, the concave portion of the end face of the paint nozzle being an annular concave portion that completely encircles the outlet opening of the paint nozzle, wherein a region of the end face is between the concave portion of the end face and the internal face of the paint nozzle, this region being a straight face or a chamfer, and wherein the concave portion of the end face extends beyond the air cap.

2. The nozzle arrangement as claimed in claim 1, wherein the portion of the external face of the paint nozzle that forms the gap is disposed so as to be substantially parallel with the internal face of the paint nozzle.

3. The nozzle arrangement as claimed in claim 1, wherein the internal face of the paint nozzle in a front region runs so as to be substantially parallel with a paint nozzle longitudinal axis.

4. The nozzle arrangement as claimed in claim 1, wherein the interior of the paint nozzle in a front region tapers in the spraying direction.

5. The nozzle arrangement as claimed in claim 1, wherein the interior of the paint nozzle in a front region widens in the spraying direction.

6. The nozzle arrangement as claimed in claim 1, wherein the end face of the paint nozzle is assembled from at least two faces which in relation to the internal face of the paint nozzle enclose dissimilar angles.

7. The nozzle arrangement as claimed in claim 1, wherein the wall that delimits the central opening of the air cap is disposed so as to be at least in part substantially parallel with the portion of the external face of the paint nozzle that forms the gap.

8. The nozzle arrangement as claimed in claim 1, wherein the wall that delimits the central opening of the air cap in a region that faces away from the spraying direction has a spacing from the external face of the paint nozzle that is larger than in a region that faces the spraying direction.

9. The nozzle arrangement as claimed in claim 1, wherein the wall that delimits the central opening of the air cap in a region that faces away from the spraying direction has a spacing from the external face of the paint nozzle that is smaller than in a region that faces the spraying direction.

10. The nozzle arrangement as claimed in claim 1, wherein the wall that delimits the central opening of the air cap is designed so as to be convex at least in regions.

11. The nozzle arrangement as claimed in claim 1, wherein the wall that delimits the central opening of the air cap is designed so as to be concave at least in regions.

12. The nozzle arrangement as claimed in claim 1, wherein the paint nozzle has at least one duct for conducting air.

13. The nozzle arrangement as claimed in claim 1, wherein said nozzle arrangement has an air-deflection disk for homogenizing the pressure conditions.

14. The nozzle arrangement as claimed in claim 1, wherein the air cap has at least two horns each having at least one horn air opening.

15. The nozzle arrangement as claimed in claim 14, wherein the air cap at least in one region between the central opening and the horns has control ducts for exhausting air.

16. The nozzle arrangement as claimed in claim 15, wherein the control ducts in the assembled state of the paint nozzle and the air cap are at least in regions disposed so as to be substantially parallel with a paint nozzle longitudinal axis.

17. A paint spray gun, wherein said paint spray gun has a nozzle arrangement as claimed in claim 1.

18. The nozzle arrangement as claimed in claim 1, wherein the region between the concave portion of the end face and the internal face is a transitional region therebetween formed by the straight face or chamfer.

19. The nozzle arrangement as claimed in claim 1, wherein the end face of the paint nozzle consists of the concave portion and the region that is the straight face or chamfer.

20. The nozzle arrangement as claimed in claim 1, wherein the at least one wall conjointly with at least part of the paint nozzle forms the gap for through which the air exits to atomize the material to be sprayed.

21. The nozzle arrangement as claimed in claim 1, wherein the gap is formed such that the air exits from the gap and generates a vacuum on the end face of the paint nozzle so as to suction the material to be sprayed from the paint nozzle.

22. The nozzle arrangement as claimed in claim 1, wherein all of the end face is located in front of the air cap.

23. The nozzle arrangement as claimed in claim 1, wherein the end face connects the external face and the internal face of the paint nozzle.

24. The nozzle arrangement as claimed in claim 1, wherein the portion of the external face of the paint nozzle that forms the gap runs substantially parallel with a paint nozzle longitudinal axis.

* * * * *